US007266919B2

(12) United States Patent
Helmlinger et al.

(10) Patent No.: US 7,266,919 B2
(45) Date of Patent: Sep. 11, 2007

(54) MOTION-DETECTING NOTE HOLDER

(75) Inventors: David Vincent Helmlinger, Mt. Laurel, NJ (US); Stephen Nicholas Weiss, Philadelphia, PA (US); Randy Cheng-Shin Chen, Marlton, NJ (US)

(73) Assignee: Parallel Products, LLC, Mount Laurel, NJ (US)

( * ) Notice: Subject to any disclaimer, the term of this patent is extended or adjusted under 35 U.S.C. 154(b) by 254 days.

(21) Appl. No.: 10/785,258

(22) Filed: Feb. 24, 2004

(65) Prior Publication Data

US 2005/0183306 A1 Aug. 25, 2005

(51) Int. Cl.
*G09F 3/18* (2006.01)

(52) U.S. Cl. ..... 40/661.02; 40/717

(58) Field of Classification Search ..... 40/124.06, 40/455, 361, 465; 281/44
See application file for complete search history.

(56) References Cited

U.S. PATENT DOCUMENTS 5,365,686 A * 11/1994 Scott ..... 40/455
5,794,371 A * 8/1998 Camillery ..... 40/717
6,292,780 B1 * 9/2001 Doederlein et al. ..... 704/270
6,361,075 B1 * 3/2002 Ritter et al. ..... 281/44
6,364,126 B1 * 4/2002 Enriquez ..... 211/13.1
6,640,474 B2 * 11/2003 Knoerzer et al. ..... 40/455
6,961,003 B2 * 11/2005 Lin ..... 340/692
2003/0156688 A1 * 8/2003 McCarty et al. ..... 379/67.1

* cited by examiner

*Primary Examiner*—Joanne Silbermann
(74) *Attorney, Agent, or Firm*—Woodcock Washburn, LLP; Joseph R Condo

(57) ABSTRACT

A motion-detecting note holder is disclosed. Such a note holder includes a note retention member, a motion sensor, a note-waiting indicator, and a controller in communication with the motion sensor and the note-waiting indicator. The controller, upon receiving a motion-detection signal from the motion sensor, causes the note-waiting indicator to provide a human-perceptible indication that a note is in the note retention member.

11 Claims, 32 Drawing Sheets

10

10

410

MOTION-DETECTING NOTE HOLDER

FIELD OF THE INVENTION

Generally, the invention relates to note holders. More particularly, the invention relates to devices that, based on a detected motion, provide an indication that a note is waiting.

BACKGROUND OF THE INVENTION

People frequently leave notes for others on chairs, desks, and the like. Such notes may be written on pages or scraps of paper, index cards, or so-called "sticky notes," such as "POST-IT" notes, for example. Such notes, left on a busy desk, for example, may be overlooked, or they may fall onto the floor and go unnoticed.

It would be desirable, therefore, if apparatus were available to detect motion in the vicinity of the apparatus, and, in response to such detection, provide a human-perceptible indication that a note is waiting.

SUMMARY OF THE INVENTION

The invention provides a motion-detecting note holder that may include a note retention member, a switch, a motion sensor, a note-waiting indicator, and a controller in communication with the switch, the motion sensor, and the note-waiting indicator. The switch may be manually actuated or actuated by insertion of a note into the note retention member. When the switch is actuated, the controller, upon receiving a motion-detection signal from the motion sensor, causes the note-waiting indicator to provide a human-perceptible indication that a note is in the note retention member.

The note-waiting indicator may include a speaker, and the controller may have a pre-programmed audio segment stored thereon. Upon receiving the motion-detection signal from the motion sensor, the controller may cause the audio segment to be played via the speaker. Alternatively or additionally, the note-waiting indicator may include a light source. Upon receiving the motion-detection signal from the motion sensor, the controller may cause the light source to provide a predefined light pattern. The controller may prevent the human-perceptible indication from being provided at least until a preset time period has elapsed.

The device may include a portable housing that contains the note retention member, the switch, the motion sensor, the note-waiting indicator, and the controller. A writing implement retention member may be attached to the housing. The housing may define a supply storage cavity. The device may include a photograph retention member.

DETAILED DESCRIPTION OF ILLUSTRATIVE EMBODIMENTS

Figure 1:
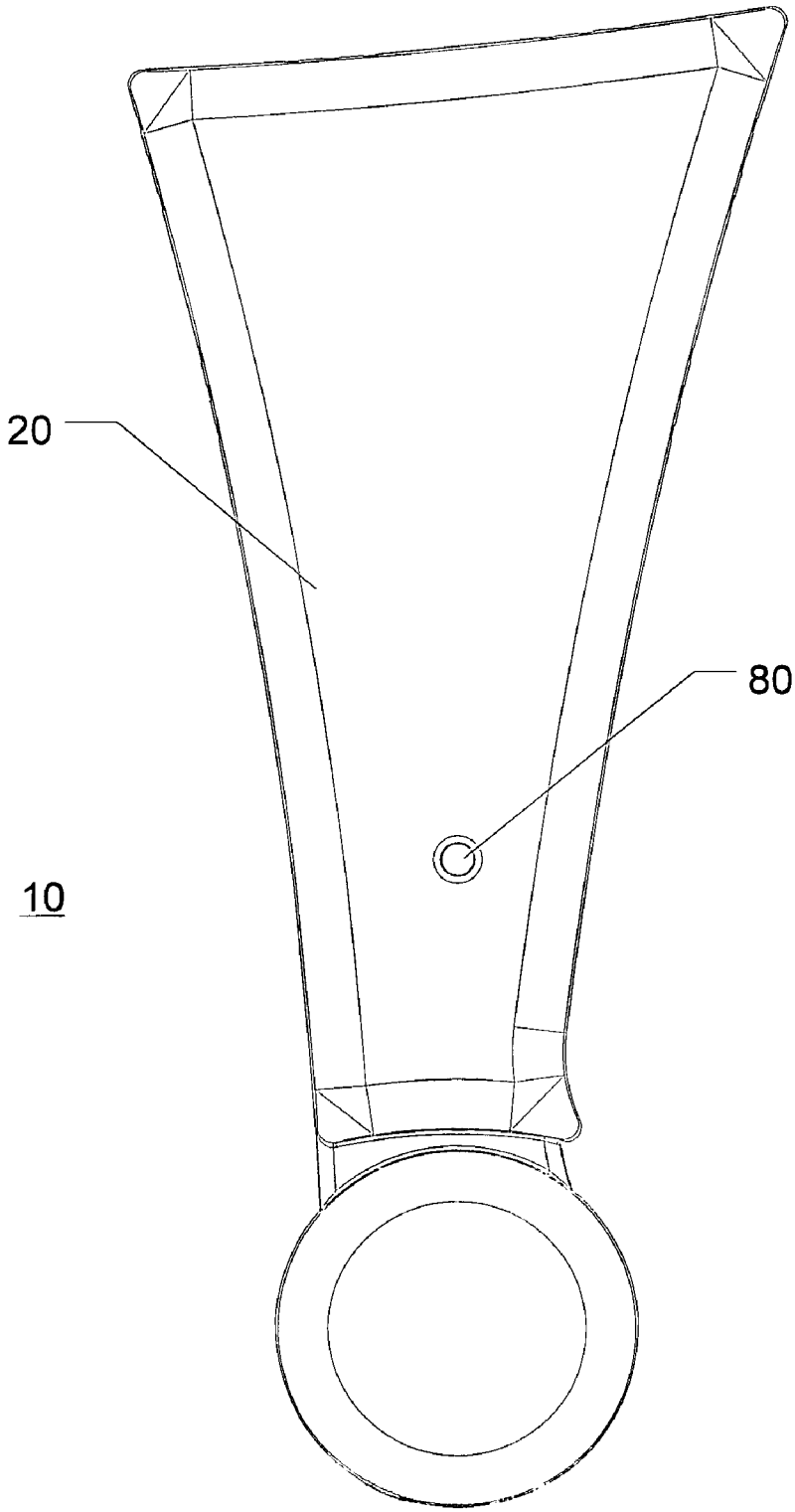
FIGS. 1 and 2 are front and rear views of an example embodiment of a motion-detecting note holder according to the invention.
Figure 2:
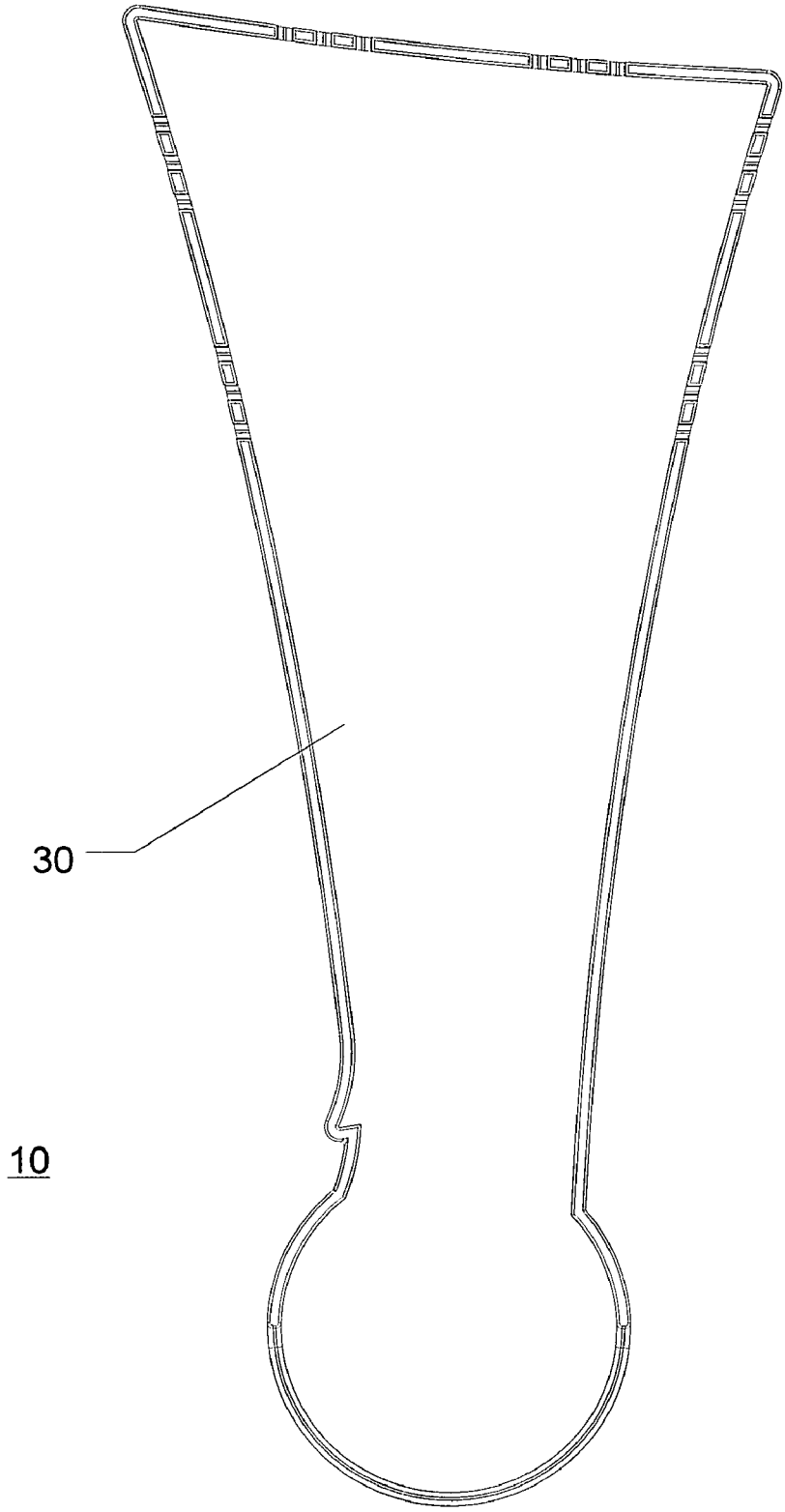
Figure 3:
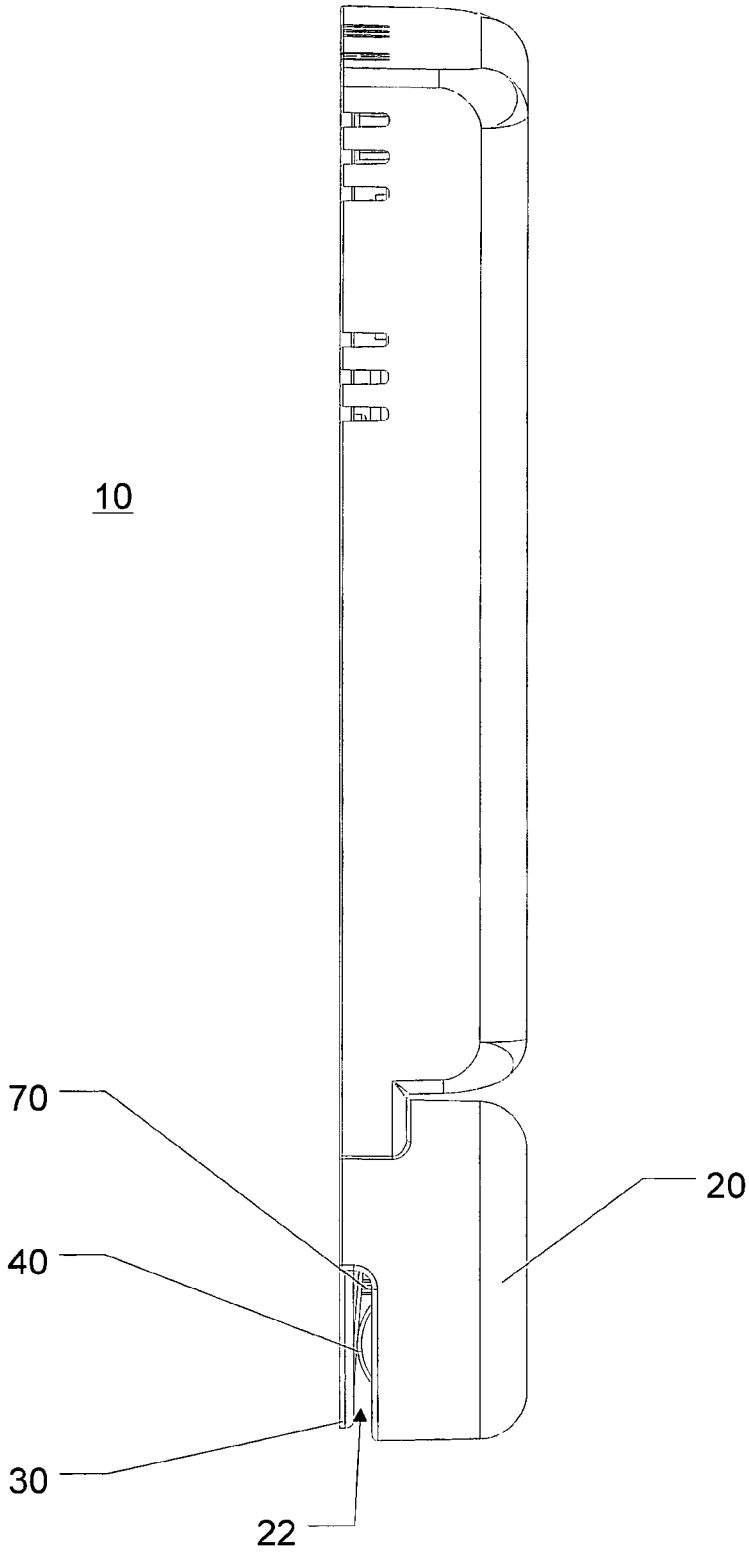
FIGS. 3 and 4 are side views of the embodiment of FIG. 1.
Figure 4:
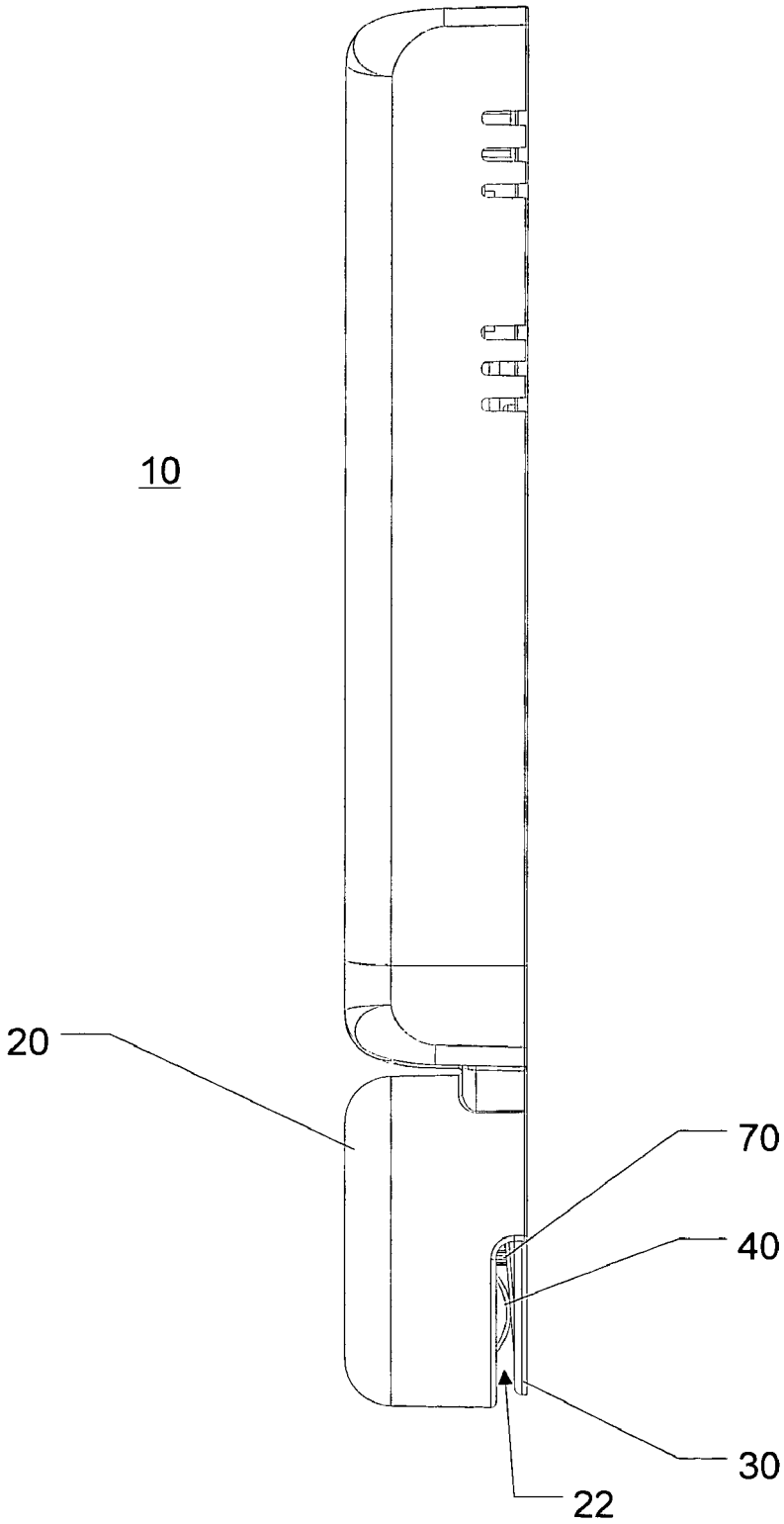
Figure 5:
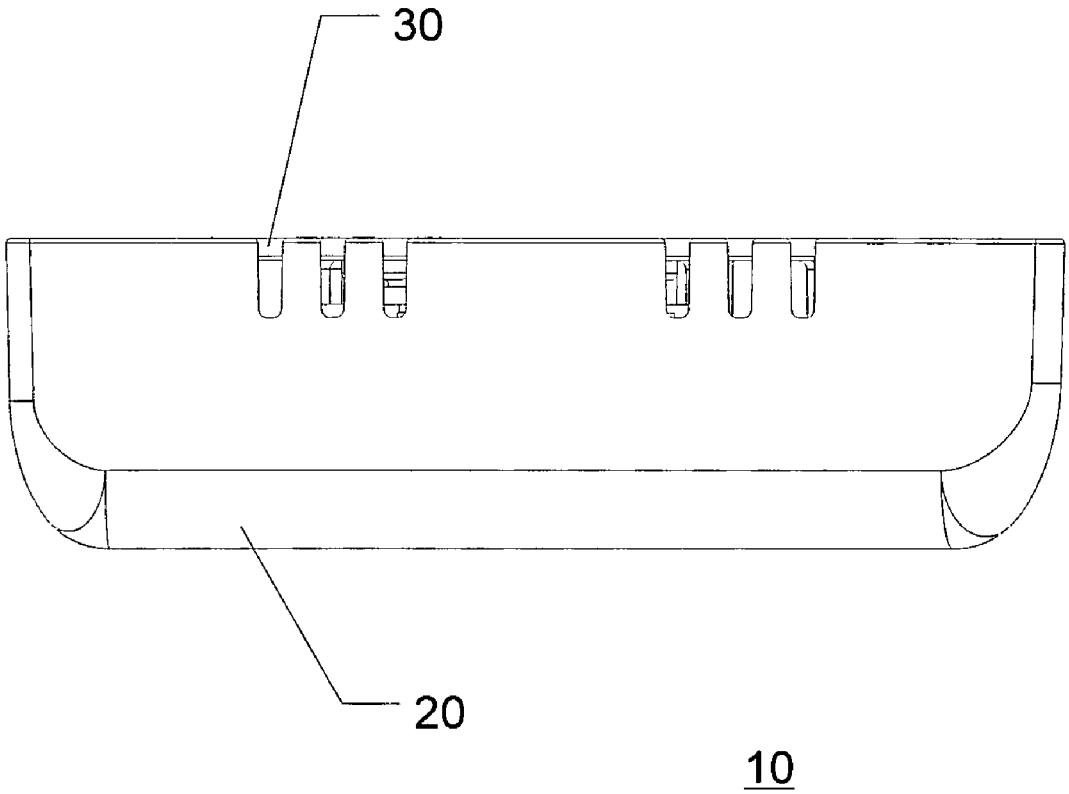
FIGS. 5 and 6 are end views of the embodiment of FIG. 1.
Figure 6:
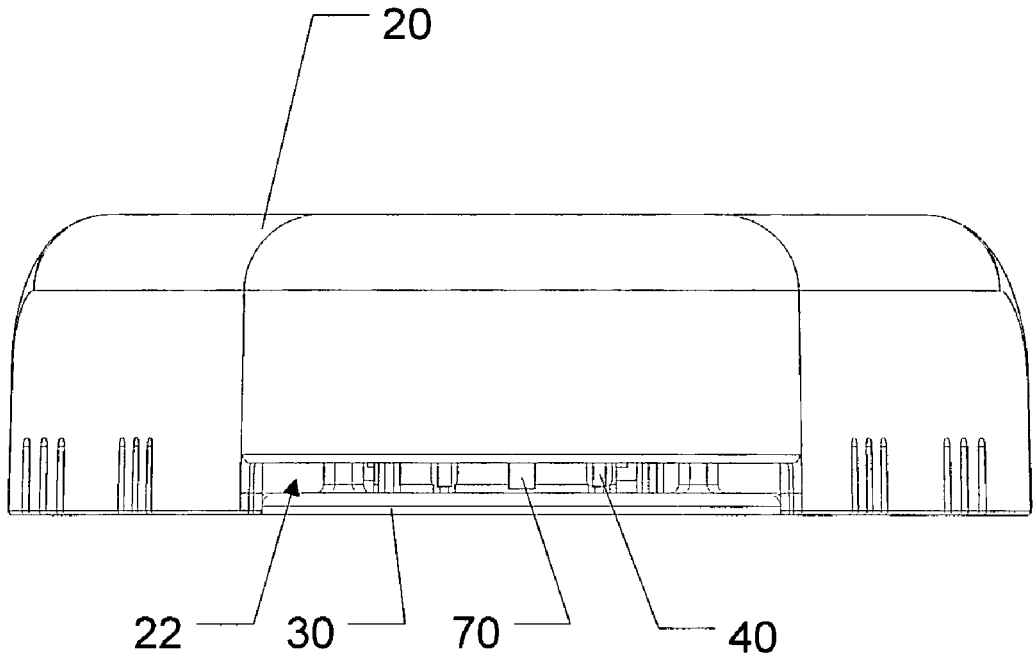
Figure 7:
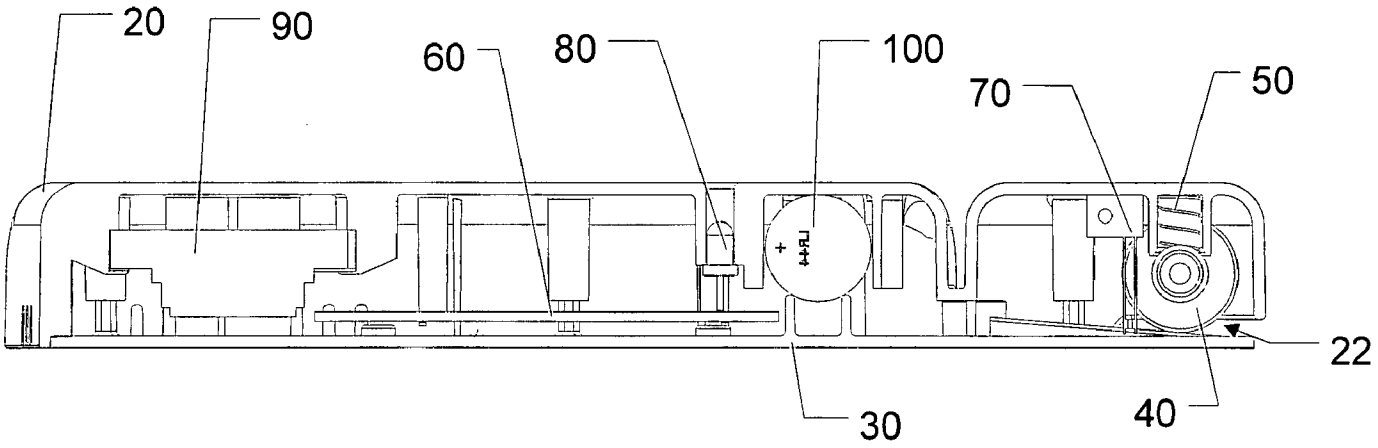
FIG. 7 is a cross-sectional view of the embodiment of FIG. 1.
Figure 8:
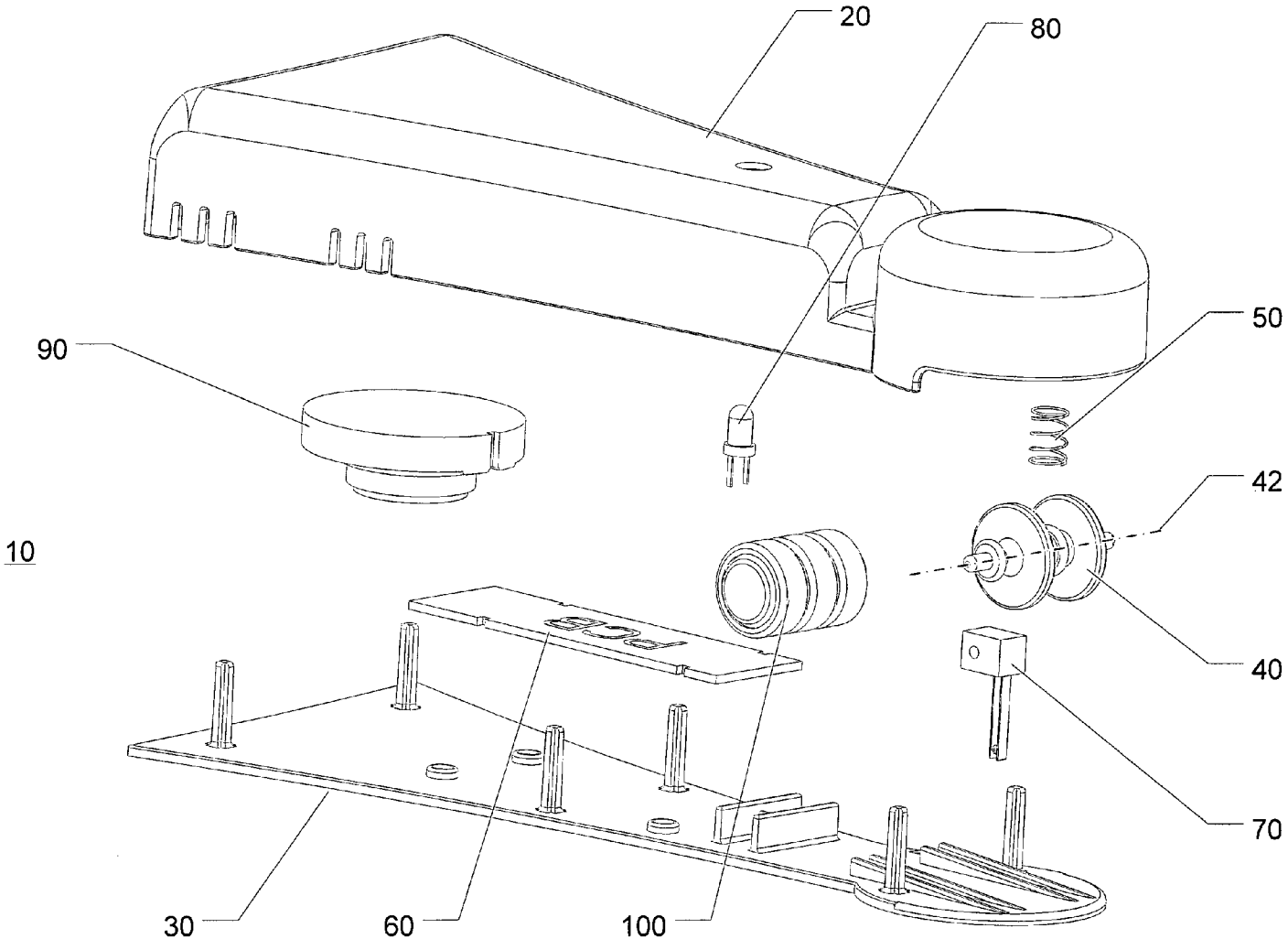
FIG. 8 is an exploded view of the embodiment of FIG. 1.

There is shown in FIGS. 1 through 8 an example embodiment of a motion-detecting note holder 10 according to the invention. As shown, the note holder 10 may include a front housing 20, a rear housing 30, a roller 40, and a spring 50. The front housing 20 and rear housing 30 may have any desired shape and size. The housings 20, 30 may be made of plastic, metal, or any desirable material, and affixed to each other to form a portable housing. The housings 20, 30 may be affixed to one another via any practical manner, such as through the use of screws, glue, epoxy, solder, etc.

The housings 20, 30 may define an interior region that may contain a control module 60, a switch 70, a motion sensor 80, a speaker 90, and a power supply 100. The power supply 100 may be any source of electrical power. Such sources may include, but are not limited to, direct-current sources, such as batteries or rectifiers, and alternating-current sources, such as power outlets commonly found in homes and commercial buildings.

A gap or slot 22 between the front and rear housings may serve as a receptacle for a note or a plurality of notes (not shown), which may be slid into the slot 22. As a note is slid into the slot 22, the note may contact the roller 40 and be directed between the roller 40 and the rear housing 30. The roller 40 may be loaded by the spring 50 towards the rear housing 30, and it may be substantially free to rotate about its own longitudinal axis 42. Friction between the note and the roller 40 may result in the rotation of the roller 40, and may also allow the note to slide between the roller 40 and the rear housing 30. Thus, the note may be effectively retained with enough force so as not to become unintentionally dislodged. It should be understood that the note may be pulled back easily out of the slot due to the rotational freedom of the roller 40.

In addition to becoming retained once slid between the roller 40 and the rear housing 30, the note may also make physical contact with the switch 70, effectively forcing the switch 70 from a normally open state to a closed state, for example. Alternatively, the switch 70 could be of a normally closed type that could be forced to an open state by the note. Thus, insertion of a note into the slot 22 may actuate the switch 70.

The switch 70 may include any number or combination of discrete components capable of carrying a current at a voltage differential sufficient to power the control module 60, motion sensor 80, and/or speaker 90. As shown, the switch 70 may include a leaf switch, for example. The switch 70 may include any combination of one or more discrete metal parts, discrete conductive ink coated film parts, carbon coated pads, etc. In a normally open configuration, the switch 70 may provide electrical communication between the control module 60 and the power supply 100 when closed. In a normally closed configuration, the switch 70, when opened, may generate a signal that is communicated to the control module 60 and causes the control module 60 to energize the motion sensor 80. Thus, the motion sensor may be activated when the switch 70 is actuated.

The control module 60 may include any number or combination of components, such as a general-purpose processor, for example, or any processor, controller, microprocessor, state machine, transistor logic, etc. The control module 60 may include discrete hardware components in various combinations with a digital signal processor (DSP), for example, and may include any storage media including, but not limited to, flash memory, EPROM memory, EEPROM memory, RAM memory, DRAM memory, SDRAM memory, ROM memory, registers, etc.

The motion sensor 80 may include any component or combination of components capable of developing a signal or charge upon the detection of motion in its vicinity. This may include, but is not limited to, infrared radiation sensors, visible radiation sensors, radio wave sensors, sound sensors, sonar sensors, vibration sensors, etc. Upon detection of motion in its vicinity, the motion sensor 80 may provide a motion-detected signal to the control module 60.

A prerecorded audio segment may be stored on the control module 60—in memory, for example. The audio segment may be a digital audio file stored in memory, for example, or it may be masked onto a component of the control module 60, such as during manufacture of a microprocessor or memory chip, for example. The audio segment may be, for example, a tone, a sequence of tones, music, or a verbal message. Generally, the audio segment may be any audio that informs a human that a note is waiting.

When the switch 70 is actuated, the control module 60, in response to receiving a motion-detected signal from the motion sensor 80, may then recall the audio segment and provide it to the speaker 90 for playback. The control module 60 may convert the audio segment into an analog signal, for example, and amplify it so that the speaker 90 is able to play it at a desired audible level. The motion-detecting note holder 10 may also include a volume control (not shown) to vary the volume level of the playback.

The note holder 10 may also include a timing sequence or delay function. That is, when the control module 60 receives a motion-detected signal from the motion sensor 80, the control module 60 may first determine whether the timing sequence is active before causing the audio segment to be played back. When the timing sequence has completed an operating cycle, meaning that a sufficient preset time has passed, the control module 60 may then cause a playback of the audible signal stored in the memory upon subsequent detection signals from the motion sensor 80. Through the inclusion of such a delay sequence, the motion-sensing note holder 10 may be prevented from playing the audio every time the motion sensor 80 senses motion. Rather, a note may be slid into the slot 22, thus latching the switch 70 to a closed position, for example. Then, after at least a preset period of time has elapsed, the note holder 10 can play the audio when the motion sensor 80 detects motion in its vicinity. Thus, such a delay function may prevent repeated playing and partial playing with re-starting of the audio while someone remains in the vicinity of the motion sensor 80, at least until no motion is detected in the vicinity of the motion sensor 80 for a pre-selected time. After the timing sequence has completed, the audio may be enabled to play again, thereby drawing attention to the note again the next time someone is in the vicinity of the motion sensor 80. Power may be removed from the control module 60 and the motion sensor 80 by removing the note from the slot 22, thus unlatching the switch 70 to an open position.

Figure 9:
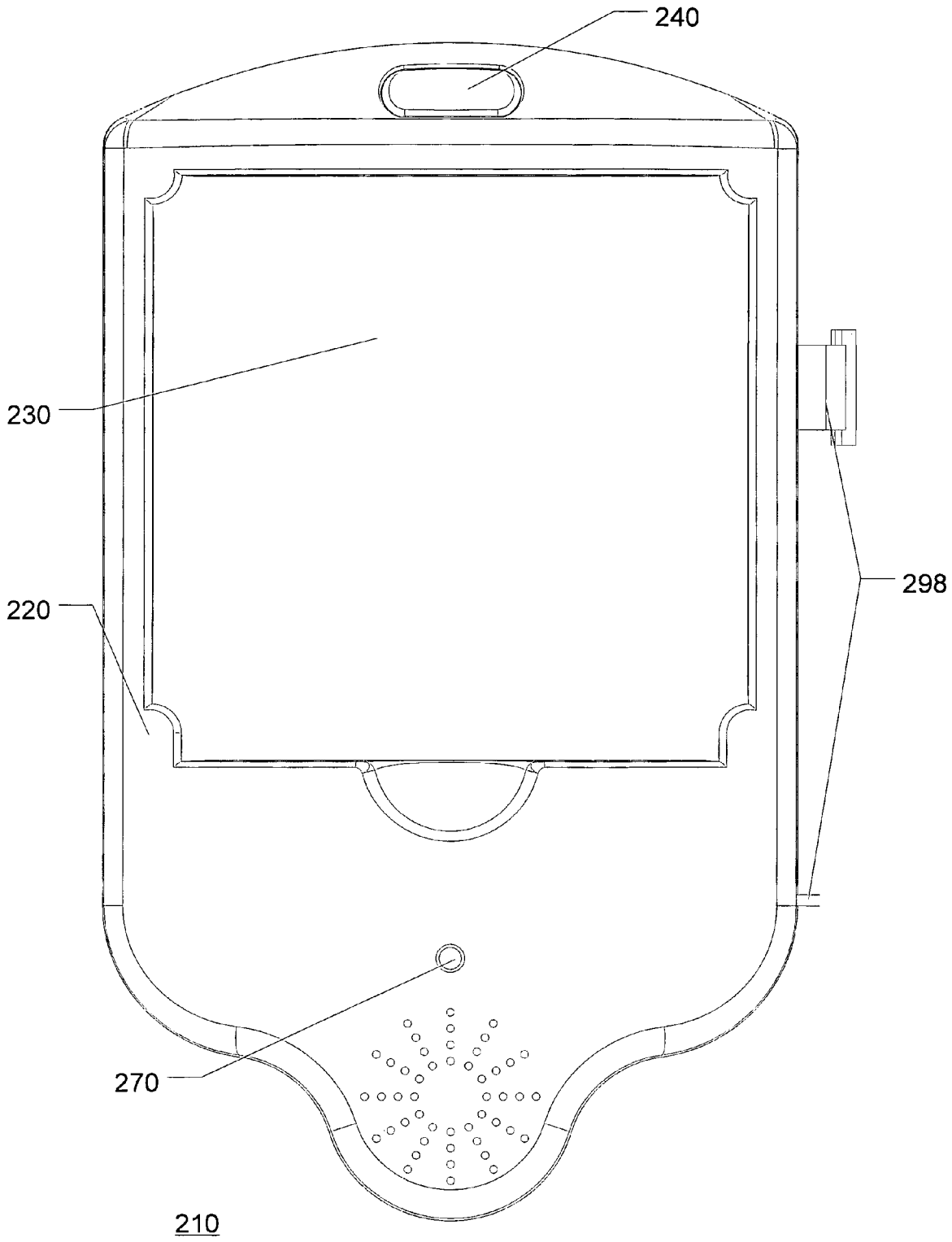
FIGS. 9 and 10 are front and rear views of another example embodiment of a motion-detecting note holder according to the invention.
Figure 10:
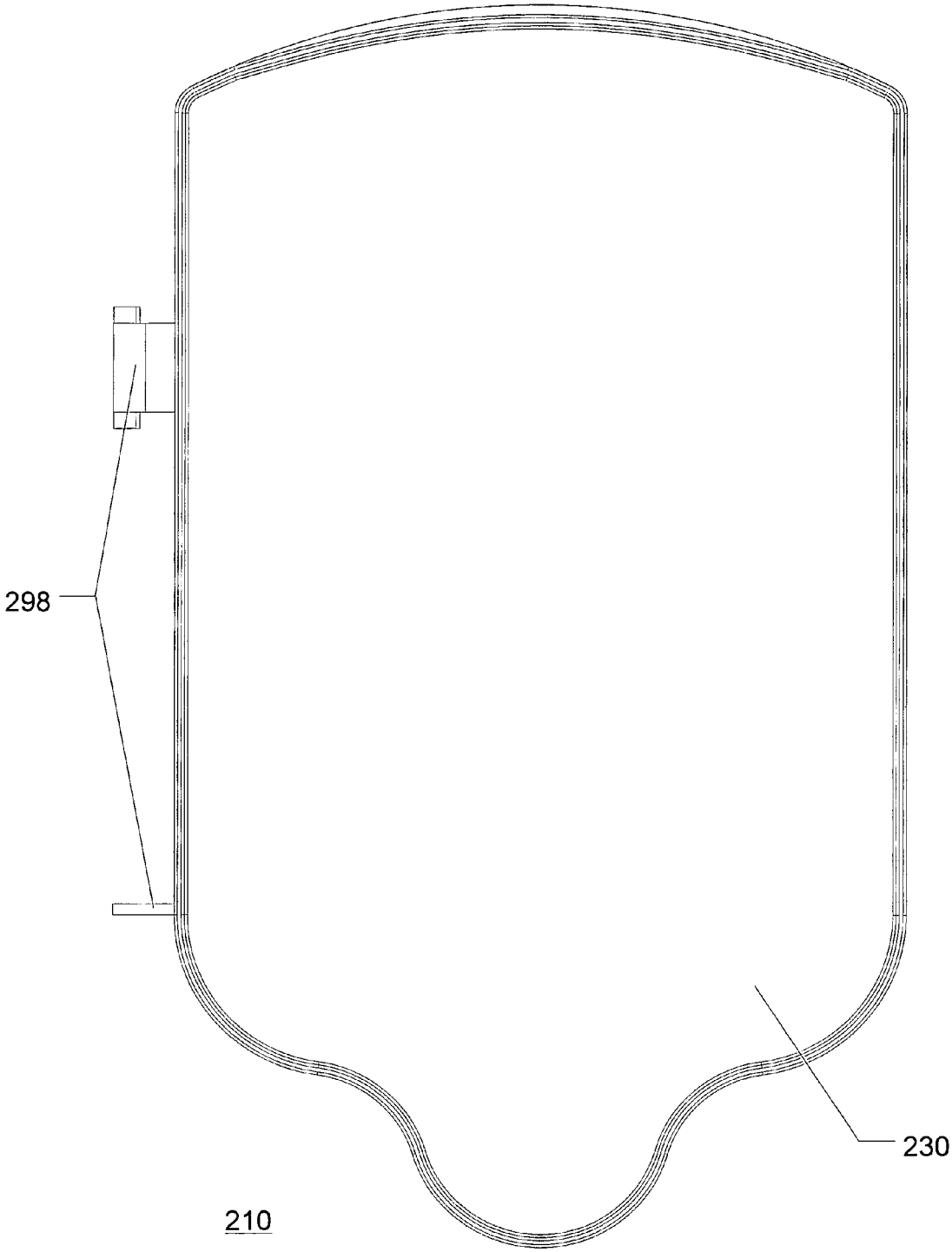
Figure 11:
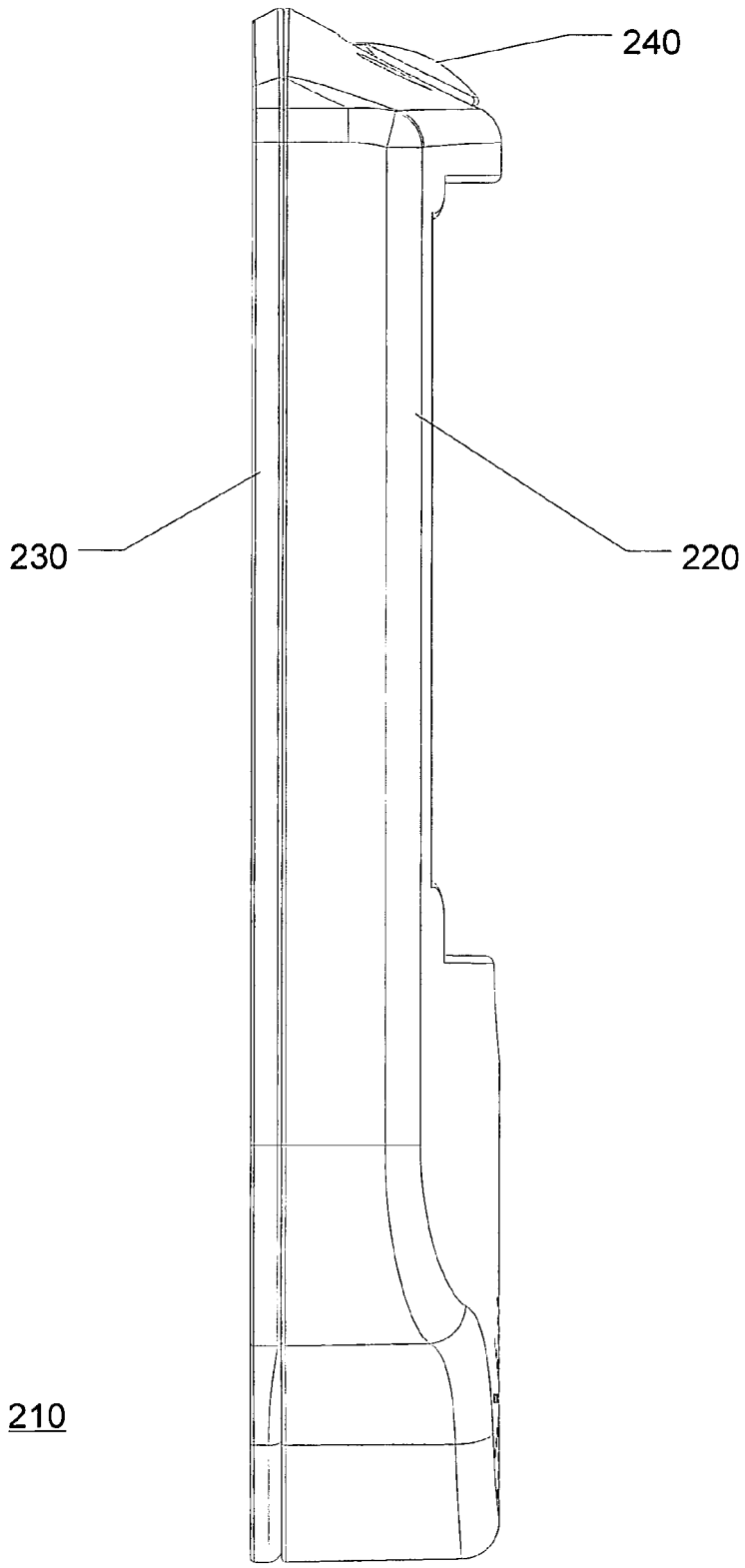
FIGS. 11 and 12 are side views of the embodiment of FIG. 9.
Figure 12:
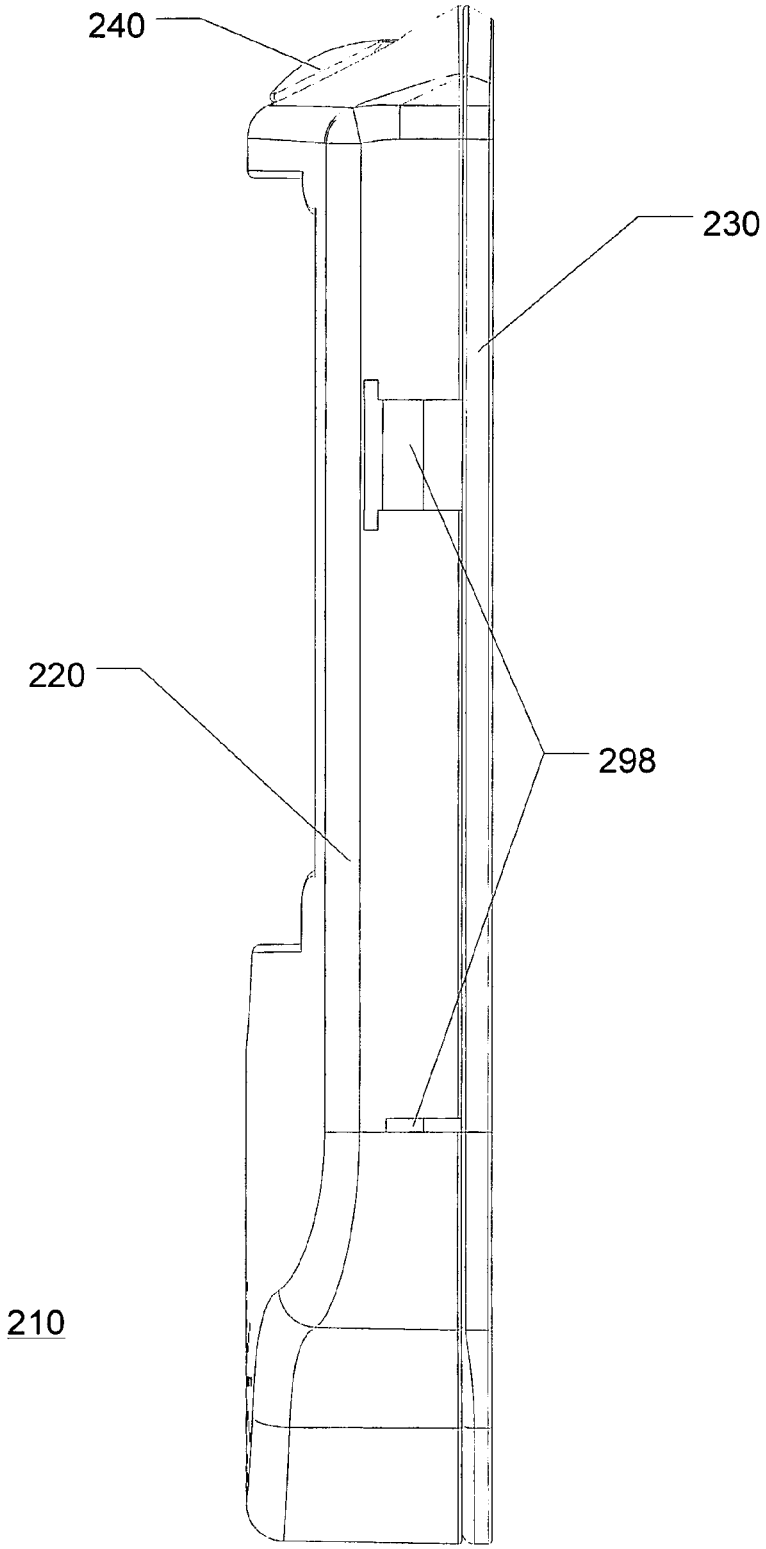
Figure 13:
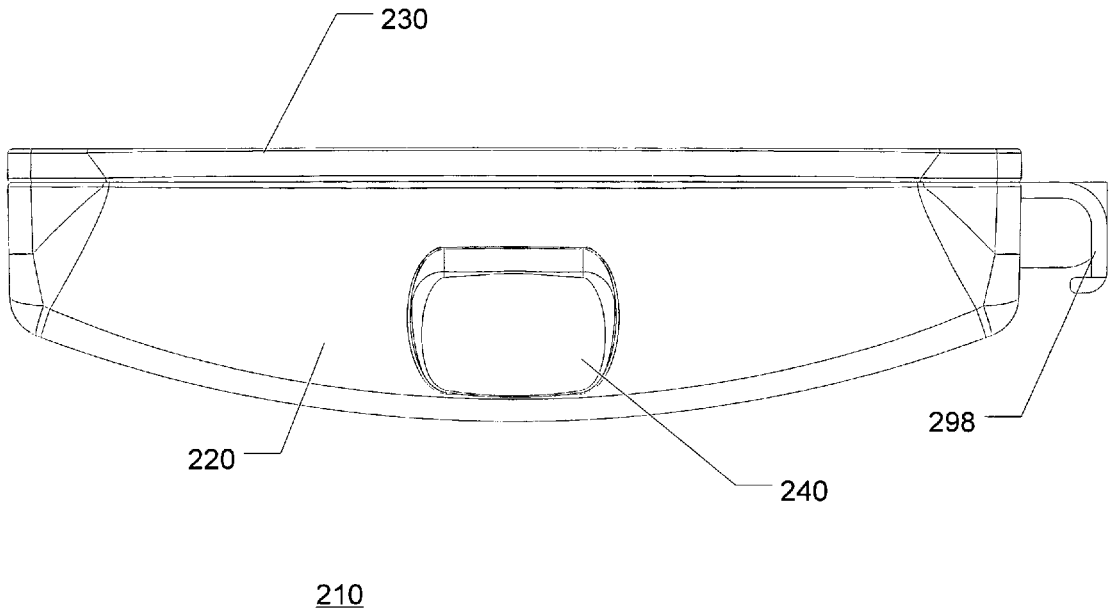
FIGS. 13 and 14 are end views of the embodiment of FIG. 9.
Figure 14:
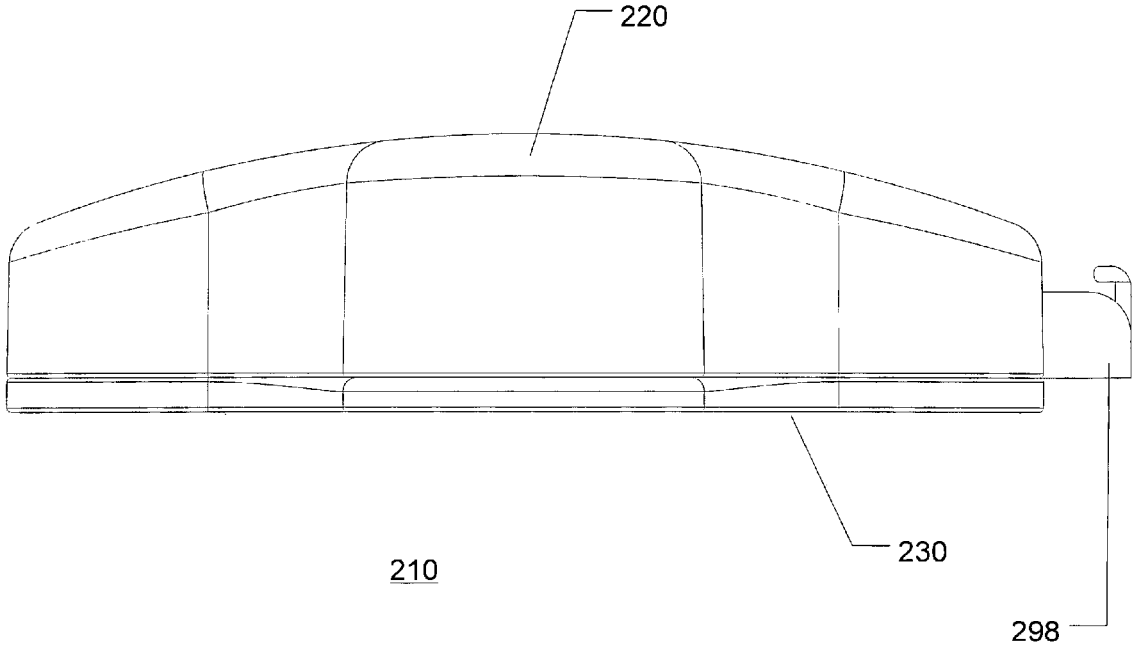
Figure 15:
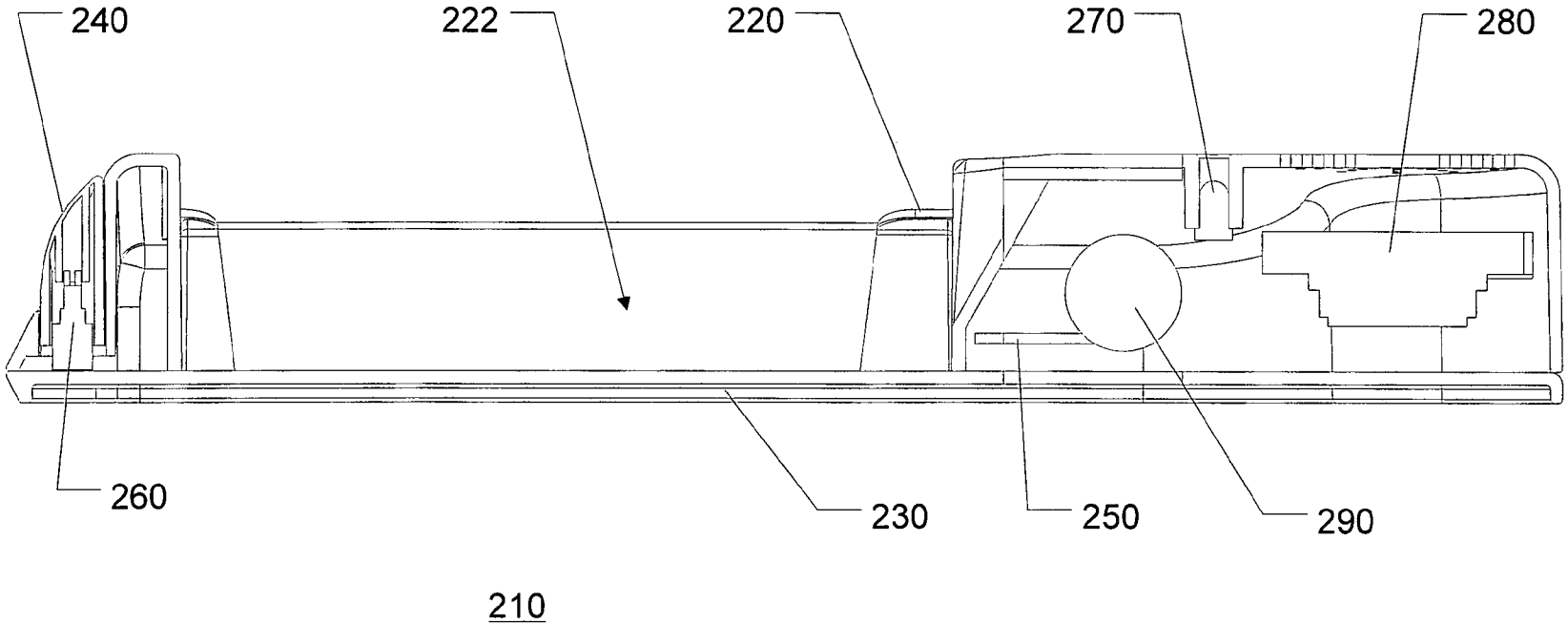
FIG. 15 is a cross-sectional view of the embodiment of FIG. 9.
Figure 16:
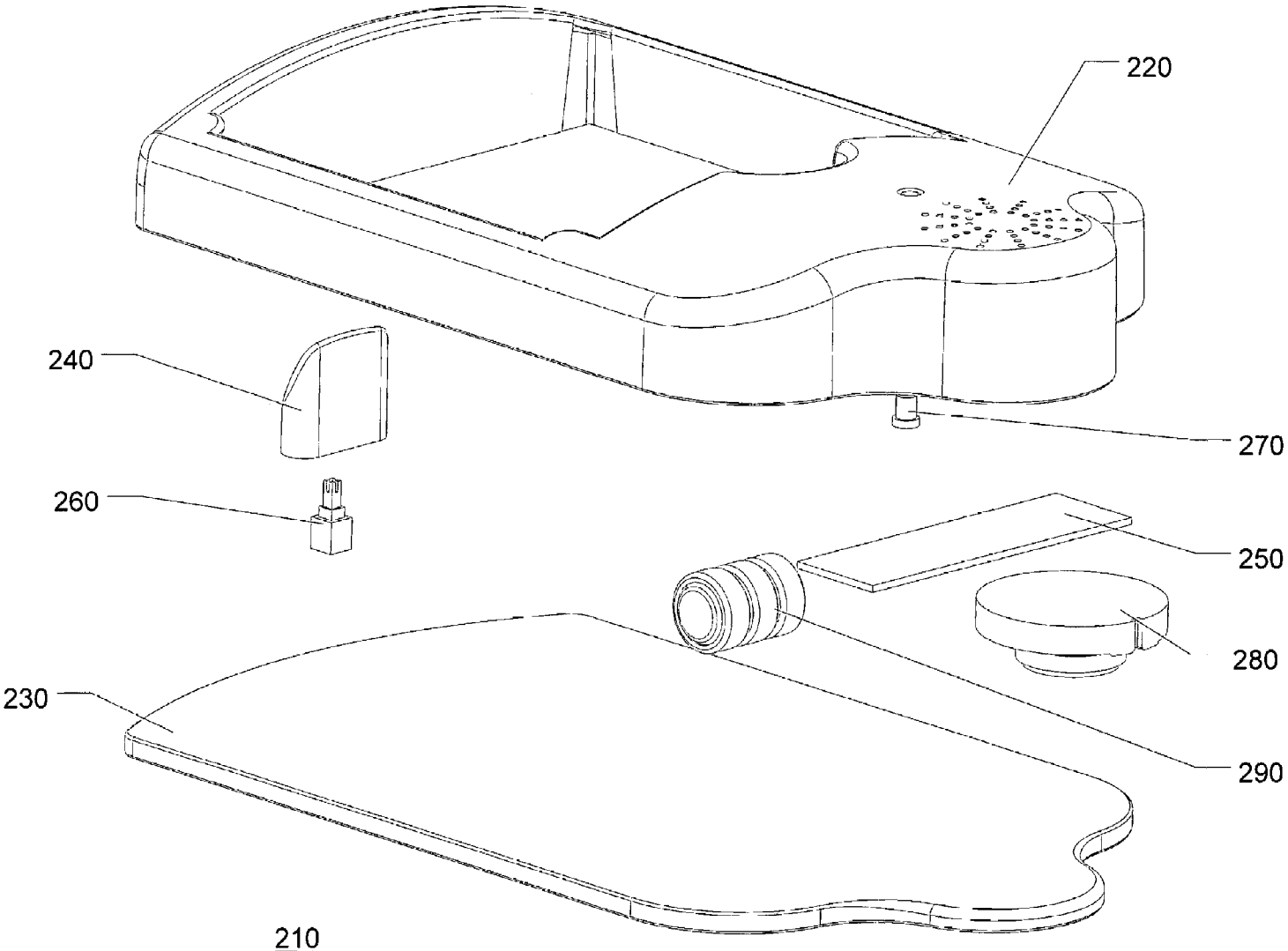
FIG. 16 is an exploded view of the embodiment of FIG. 9.

FIGS. 9 through 16 depict another example embodiment of a motion-detecting note holder 210 according to the invention. As shown, the note holder 210 may include a front housing 220, a rear housing 230, and a switch cover 240. The housings 220, 230 may have any desired shape and size, and may be made of plastic, metal, or any desirable material. The housings 220, 230 may be affixed to one another to form a portable housing via any practical manner, such as through the use of screws, glue, epoxy, solder, etc.

The housings 220, 230 may define an interior region that may contain a control module 250, a switch 260, a motion sensor 270, a speaker 280, and a power supply 290. The power supply 290 may be any source of electrical power. Such sources may include, but are not limited to, direct-current sources, such as batteries or rectifiers, and alternating-current sources, such as power outlets commonly found in homes and commercial buildings.

A writing implement retention member 298 may be attached to the portable housing 220, 230. The retention member 298 may be configured (e.g., sized and shaped) to hold a writing implement such as a pen, pencil, marker, or the like. The housings 220, 230 may also define a note retention cavity 222 adapted to receive and retain one or more notes or a note pad (not shown).

The switch 260 may be of a normally-open or normally-closed, electronically and/or mechanically latched design, capable of carrying a current at a voltage differential sufficient to power the control module 250, motion sensor 270, and/or speaker 280. As shown, the switch 260 may include a manually-actuated switch, such as a push switch, for example. The switch 260 may include any combination of one or more discrete metal parts, discrete conductive ink coated film parts, carbon coated pads, etc. In a normally open configuration, the switch 260 may provide electrical communication between the control module 250 and the power supply 290 when closed. In a normally closed configuration, the switch 260, when opened, may generate a signal that is communicated to the control module 250 and causes the control module 250 to energize the motion sensor 270. Thus, the motion sensor may be activated when the switch 260 is actuated.

The control module 250 may include any number or combination of components, such as a general-purpose processor, for example, or any processor, controller, microprocessor, state machine, transistor logic, etc. The control module 250 may include discrete hardware components in various combinations with a digital signal processor (DSP), for example, and may include any storage medium including, but not limited to, flash memory, EPROM memory, EEPROM memory, RAM memory, DRAM memory, SDRAM memory, ROM memory, registers, etc.

The motion sensor 270 may include any component or combination of components capable of developing a signal or charge upon the detection of motion in its vicinity. This may include, but is not limited to, infrared radiation sensors, visible radiation sensors, radio wave sensors, sound sensors, sonar sensors, vibration sensors, etc. Upon detection of motion in its vicinity, the motion sensor 270 may provide a motion-detected signal to the control module 250.

As described above, a prerecorded audio segment may be stored on the control module 250. Upon receiving the motion-detected signal from the motion sensor 270, the control module 250 may then recall the audio segment and provide it to the speaker 270 for playback. The control module 250 may convert the audio segment into an analog signal and amplify it so that the speaker 280 is able to play it at a desired audible level. The motion-detecting note holder 210 may also include a volume control (not shown) to vary the volume level of the playback.

As described above, the note holder 210 may also include a timing sequence or delay function so that, when the control module 250 receives a motion-detected signal from the motion sensor 270, the control module 250 may first determine whether the timing sequence is active, thereby precluding subsequent playback operations. Through the inclusion of such a delay sequence, the device 210 may be prevented from playing the audio every time the motion sensor 270 senses motion. Rather, a message may be written on a note or note pad retained in the cavity 222 and the switch cover 240 pressed. Thus, the switch 260 may be latched closed, for example, to cause the power supply 290 to energize the control module 250 and motion sensor 270. After at least a preset period of time has elapsed, the note holder 210 can play the audio when the motion sensor 270 detects motion in its vicinity. Thus, such a delay function may prevent repeated playing and partial playing With re-starting of the audio while someone remains in the vicinity of the motion sensor 270, at least until no motion is detected in the vicinity of the motion sensor 270 for a pre-selected time. After the timing sequence has completed, the audio may be enabled to play again, thereby drawing attention to the note again the next time someone is in the vicinity of the motion sensor 270. Power may be removed from the control module 250 and the motion sensor 270 by pressing the switch cover 240 again, thus unlatching the switch 260 to an open position.

Figure 17:
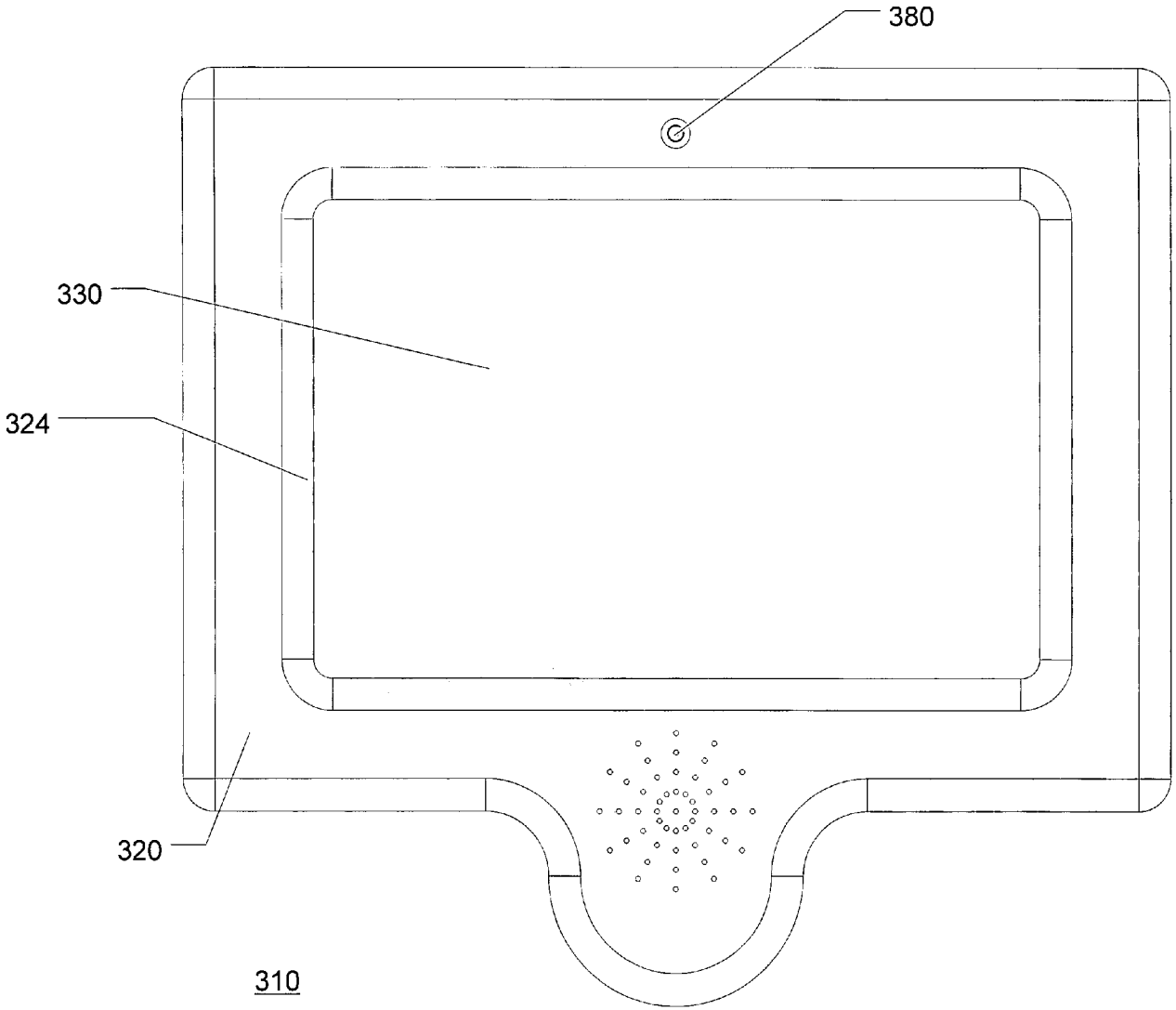
FIGS. 17 and 18 are front and rear views of yet another example embodiment of a motion-detecting note holder according to the invention.
Figure 18:
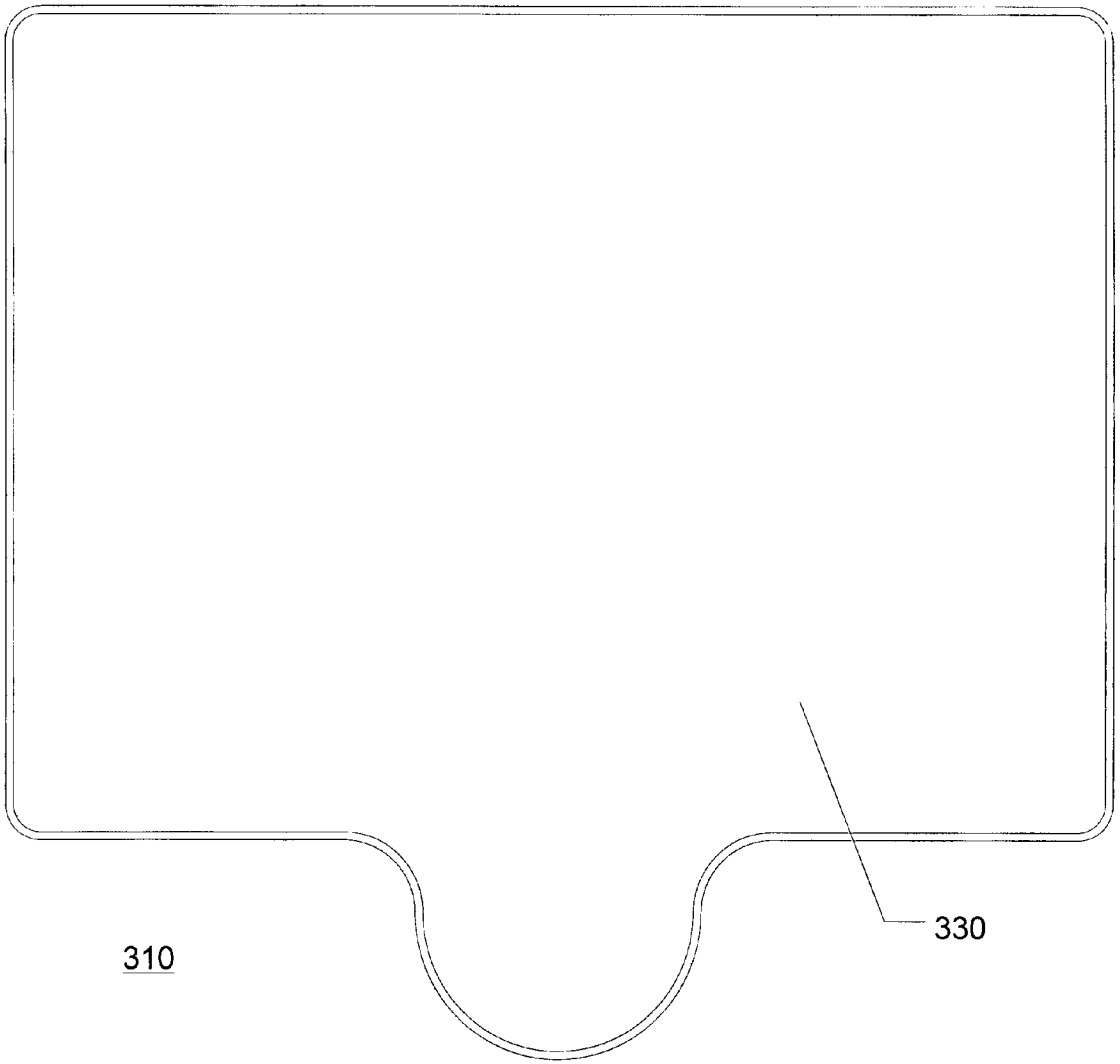
Figure 19:
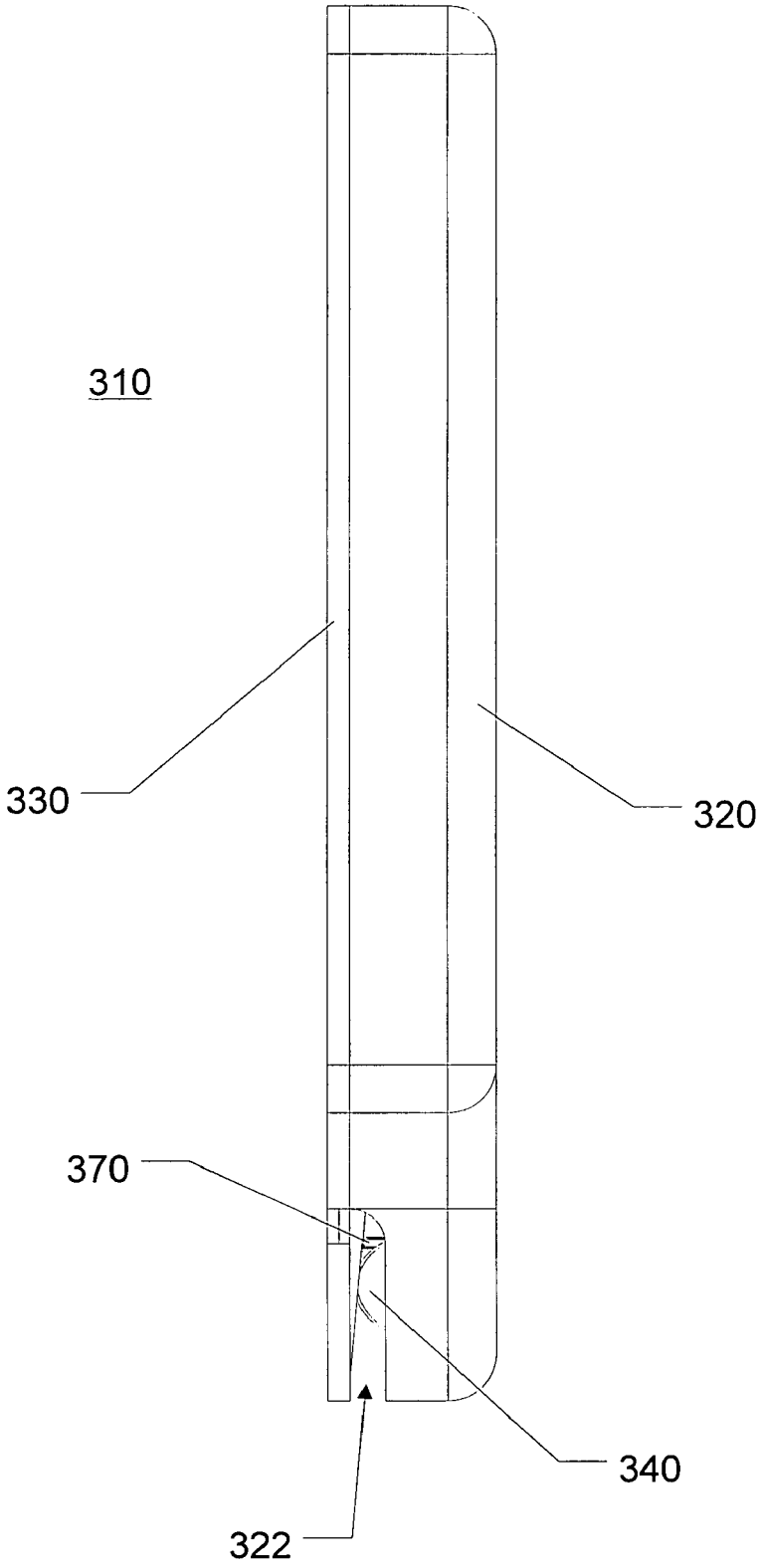
FIGS. 19 and 20 are side views of the embodiment of FIG. 17.
Figure 20:
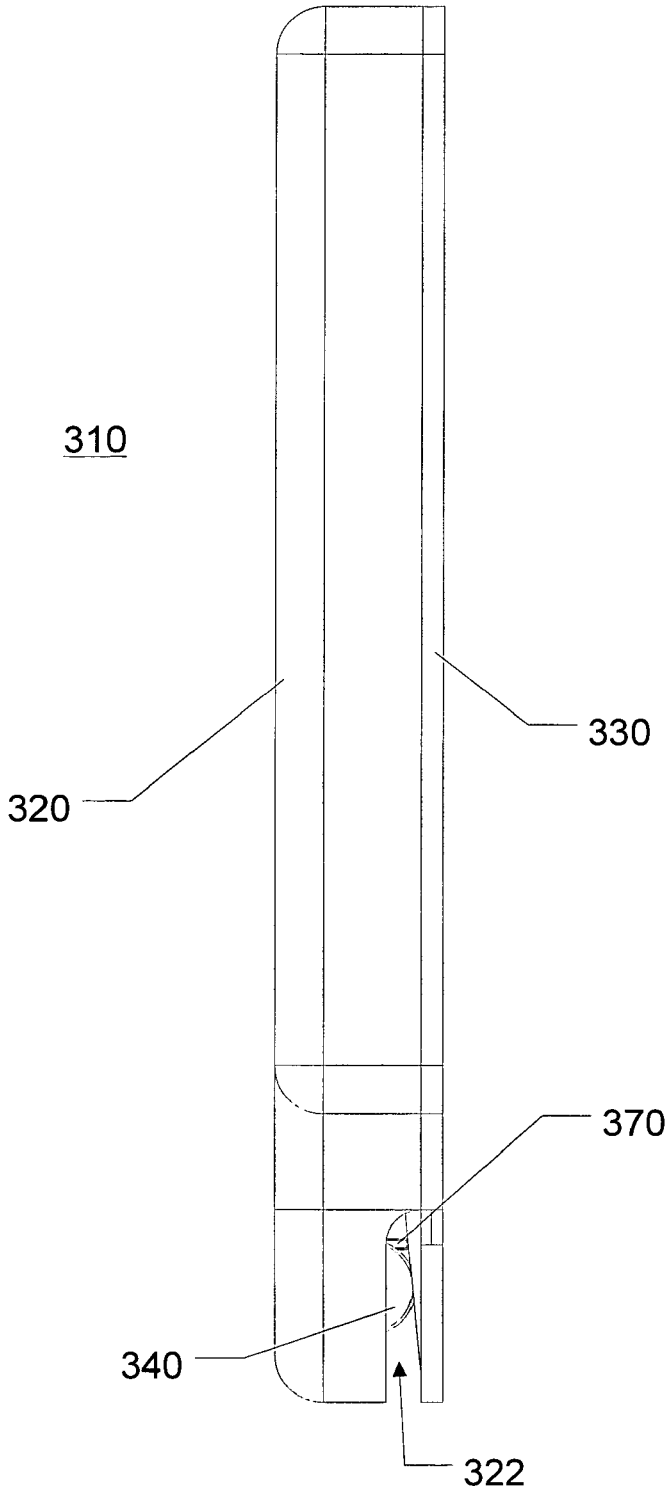
Figure 21:
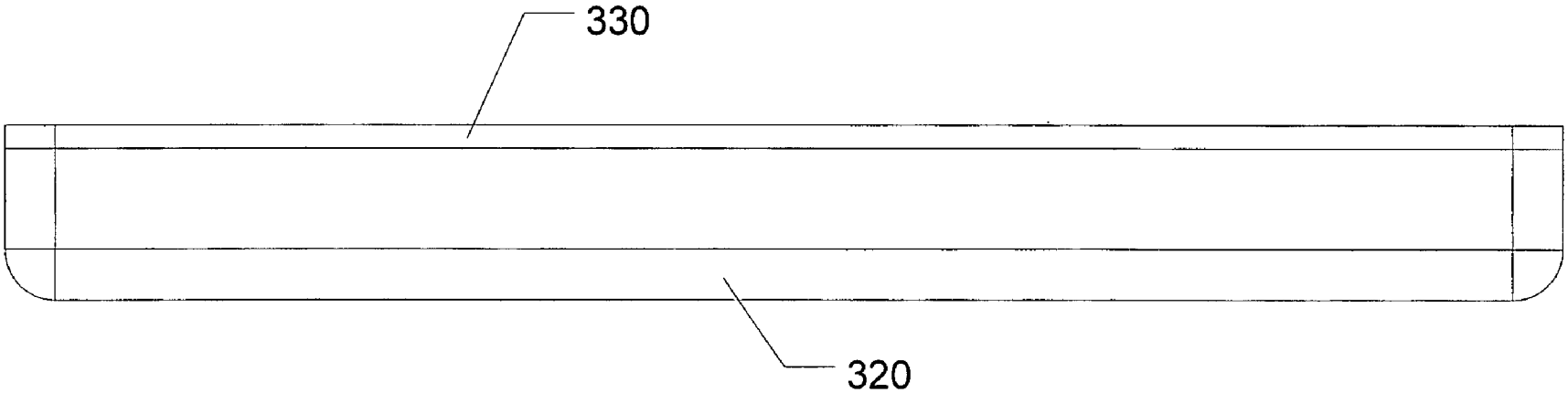
FIGS. 21 and 22 are end views of the embodiment of FIG. 17.
Figure 22:
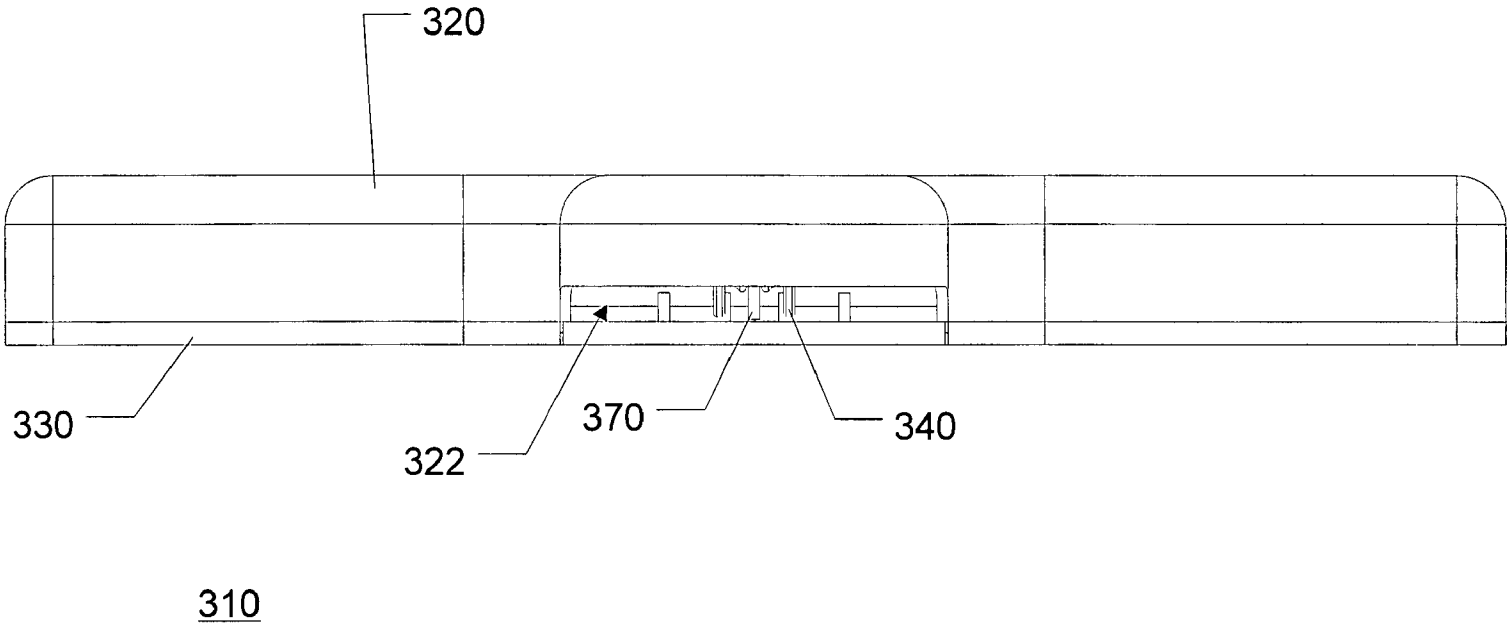
Figure 23:
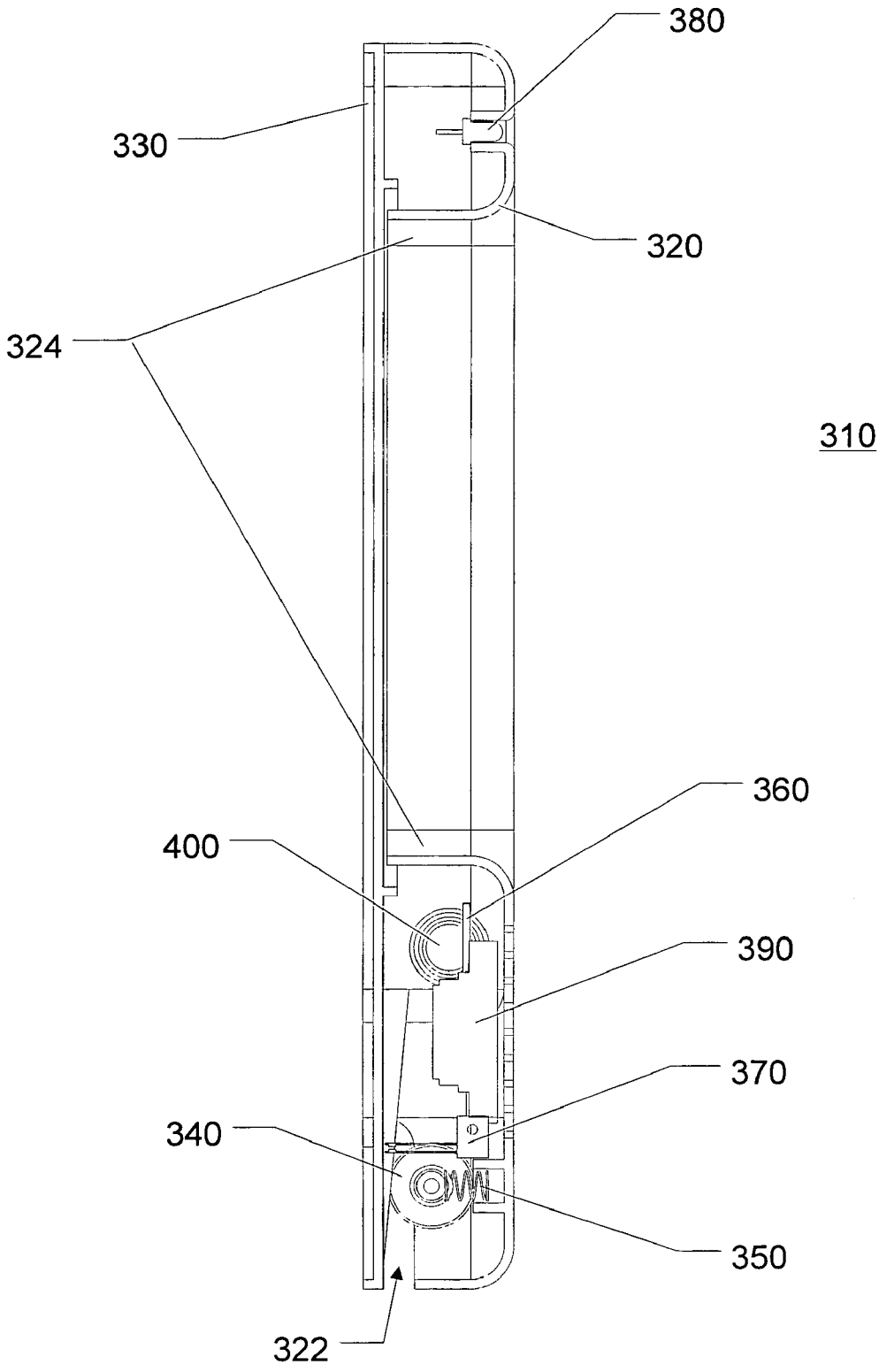
FIG. 23 is a cross-sectional view of the embodiment of FIG. 17.
Figure 24:
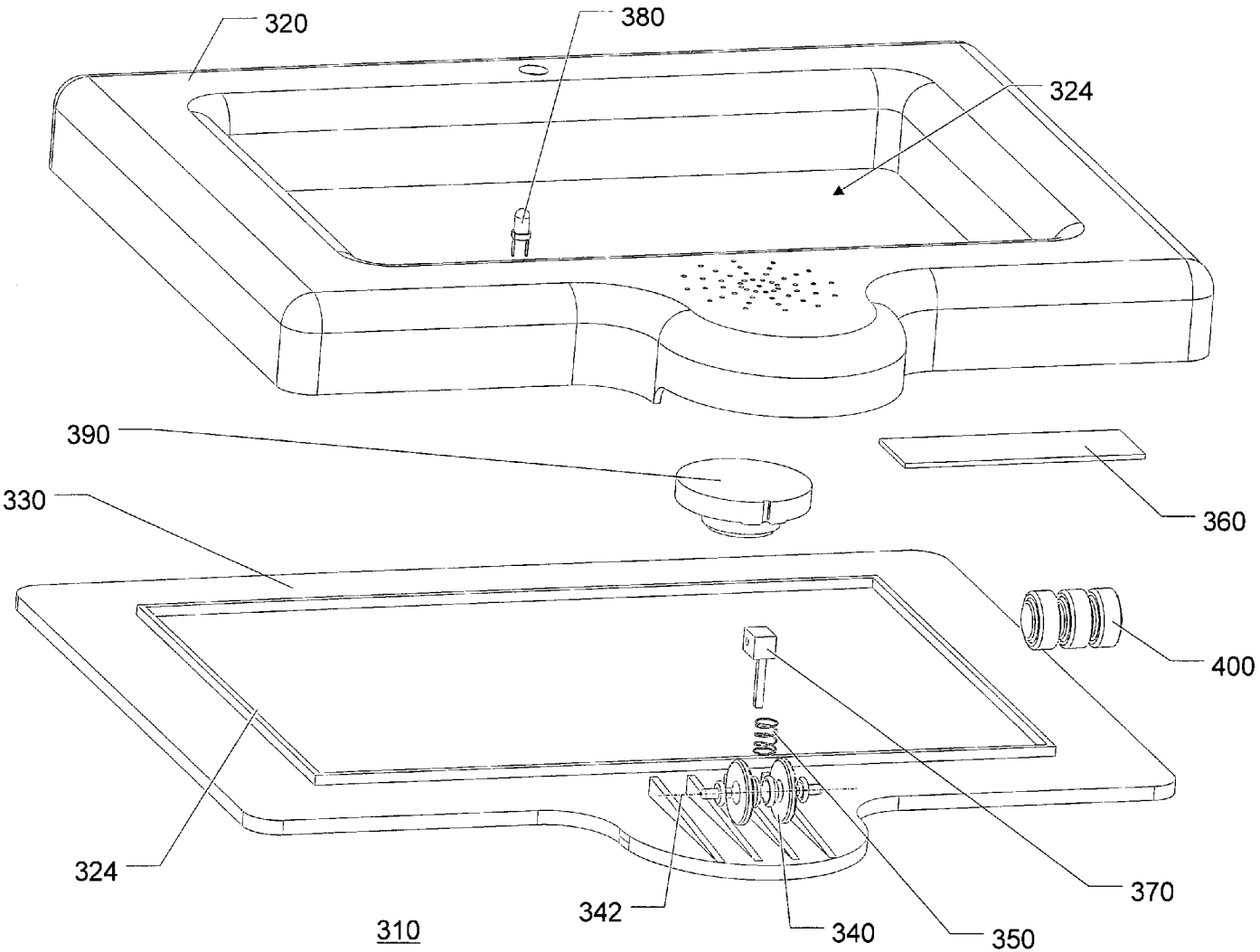
FIG. 24 is an exploded view of the embodiment of FIG. 17.
Figure 25:
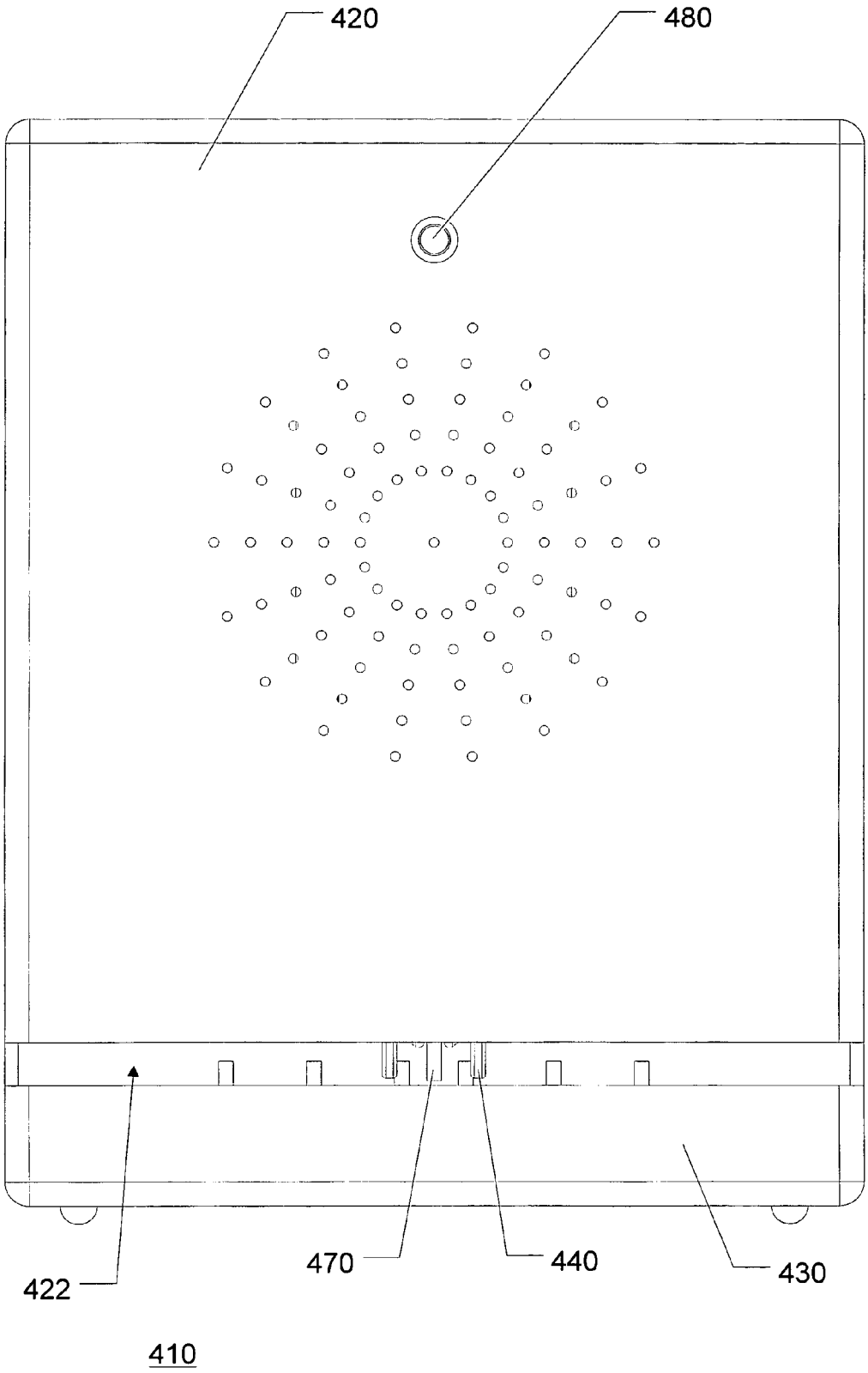
FIGS. 25 and 26 are front and rear views of still another example embodiment of a motion-detecting note holder according to the invention.

FIGS. 17 through 25 depict yet another example embodiment of a motion-detecting note holder 310 according to the invention. As shown, the note holder 310 may include a front housing 320, a rear housing 330, a roller 340, and a spring 350. The front housing 320 and rear housing 330 may have any desired shape and size, and may be made of plastic, metal, or any desirable material. The housings 320, 330 may be affixed to one another to form a portable housing via any practical manner, such as through the use of screws, glue, epoxy, solder, etc.

The housings 320, 330 may define an interior region that may contain a control module 360, a switch 370, a motion sensor 380, a speaker 390, and a power supply 400. The power supply 400 may be any source of electrical power. Such sources may include, but are not limited to, direct-current sources, such as batteries or rectifiers, and alternating-current sources, such as power outlets commonly found in homes and commercial buildings.

The housings 320, 330 may define a photo retention member 324. For example, the housings 320, 330 may be sized and shaped such that a photograph (not shown) may be retained between the front housing 320 and the rear housing 330 in a manner such that the photograph may be seen from the front of the device 310. As shown in FIGS. 17-24, the front housing 320 may be sized and shaped in the manner of a picture frame or photo holder.

A gap or slot 322 between the front and rear housings may serve as a receptacle for a note or a plurality of notes (not shown), which may be slid into the slot 322. As a note is slid into the slot 322, the note may contact the roller 340 and be directed between the roller 340 and the rear housing 330. The roller 340 may be loaded by the spring 350 towards the rear housing 330, and it may be substantially free to rotate about its own longitudinal axis 342. Friction between the note and the roller 340 may result in the rotation of the roller 340, and may also allow the note to slide between the roller 340 and the rear housing 330. Thus, the note may be effectively retained with enough force so as not to become unintentionally dislodged. It should be understood that the note may be pulled back easily out of the slot due to the rotational freedom of the roller 340.

In addition to becoming retained once slid between the roller 340 and the rear housing 330, the note may also make physical contact with the switch 370, effectively forcing the switch 370 from a normally open state to a closed state, for example. Alternatively, the switch 370 could be of a normally closed type that could be forced to an open state by the note. Thus, insertion of a note into the slot 322 may actuate the switch 370.

The switch 370 may include any number or combination of discrete components capable of carrying a current at a voltage differential sufficient to power the control module 360, motion sensor 380, and/or speaker 390. As shown, the switch 370 may include a leaf switch, for example. The switch 370 may include any combination of one or more discrete metal parts, discrete conductive ink coated film parts, carbon coated pads, etc. In a normally open configuration, the switch 370 may provide electrical communication between the control module 360 and the power supply 400 when closed. In a normally closed configuration, the switch 370, when opened, may generate a signal that is communicated to the control module 360 and causes the control module 360 to energize the motion sensor 380. Thus, the motion sensor may be activated when the switch 370 is actuated.

The control module 360 may include any number or combination of components, such as a general-purpose processor, for example, or any processor, controller, microprocessor, state machine, transistor logic, etc. The control module 360 may include discrete hardware components in various combinations with a digital signal processor (DSP), for example, and may include any storage media including, but not limited to, flash memory, EPROM memory, EEPROM memory, RAM memory, DRAM memory, SDRAM memory, ROM memory, registers, etc.

The motion sensor 380 may include any component or combination of components capable of developing a signal or charge upon the detection of motion in its vicinity. This may include, but is not limited to, infrared radiation sensors, visible radiation sensors, radio wave sensors, sound sensors, sonar sensors, vibration sensors, etc. Upon detection of motion in its vicinity, the motion sensor 380 may provide a motion-detected signal to the control module 360.

A prerecorded audio segment may be stored on the control module 360—in memory, for example. The audio segment may be a digital audio file stored in memory, for example, or it may be masked onto a component of the control module 360, such as during manufacture of a microprocessor or memory chip, for example. The audio segment may be, for example, a tone, a sequence of tones, music, or a verbal message. Generally, the audio segment may be any audio that informs a human that a note is waiting.

When the switch 370 is actuated, the control module 360, in response to receiving a motion-detected signal from the motion sensor 380, may then recall the audio segment and provide it to the speaker 390 for playback. The control module 360 may convert the audio segment into an analog signal, for example, and amplify it so that the speaker 390 is able to play it at a desired audible level. The motion-detecting note holder 310 may also include a volume control (not shown) to vary the volume level of the playback.

The note holder 310 may also include a timing sequence or delay function. That is, when the control module 360 receives a motion-detected signal from the motion sensor 380, the control module 360 may first determine whether the timing sequence is active before causing the audio segment to be played back. When the timing sequence has completed an operating cycle, meaning that a sufficient preset time has passed, the control module 360 may then cause a playback of the audible signal stored in the memory upon subsequent detection signals from the motion sensor 380. Through the inclusion of such a delay sequence, the motion-sensing note holder 310 may be prevented from playing the audio every time the motion sensor 380 senses motion. Rather, a note may be slid into the slot 322, thus latching the switch 370 to a closed position, for example. Then, after at least a preset period of time has elapsed, the note holder 310 can play the audio when the motion sensor 380 detects motion in its vicinity. Thus, such a delay function may prevent repeated playing and partial playing with re-starting of the audio while someone remains in the vicinity of the motion sensor 380, at least until no motion is detected in the vicinity of the motion sensor 380 for a pre-selected time. After the timing sequence has completed, the audio may be enabled to play again, thereby drawing attention to the note again the next time someone is in the vicinity of the motion sensor 380. Power may be removed from the control module 360 and the motion sensor 380 by removing the note from the slot 322, thus unlatching the switch 370 to an open position.

Figure 26:
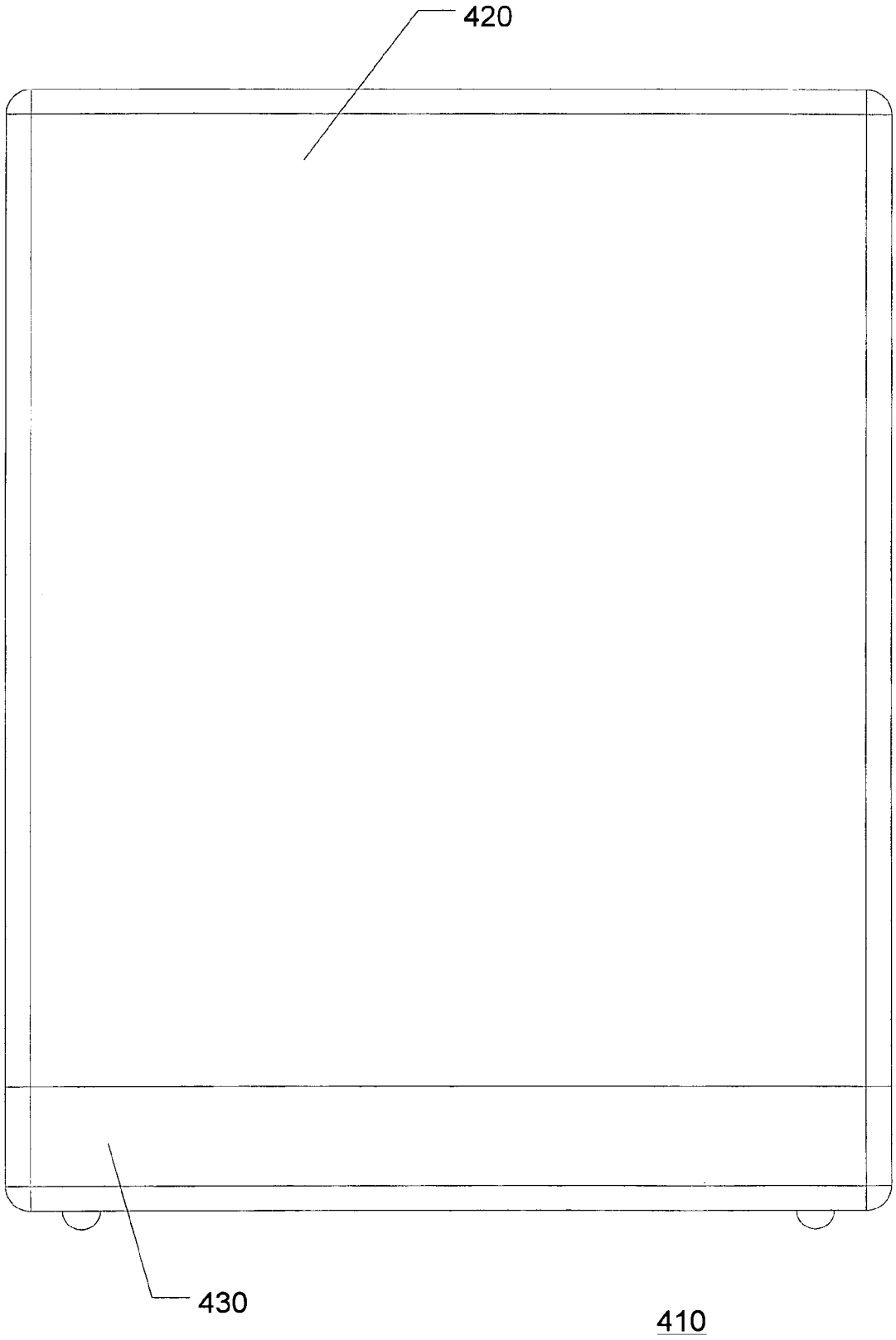
Figure 27:
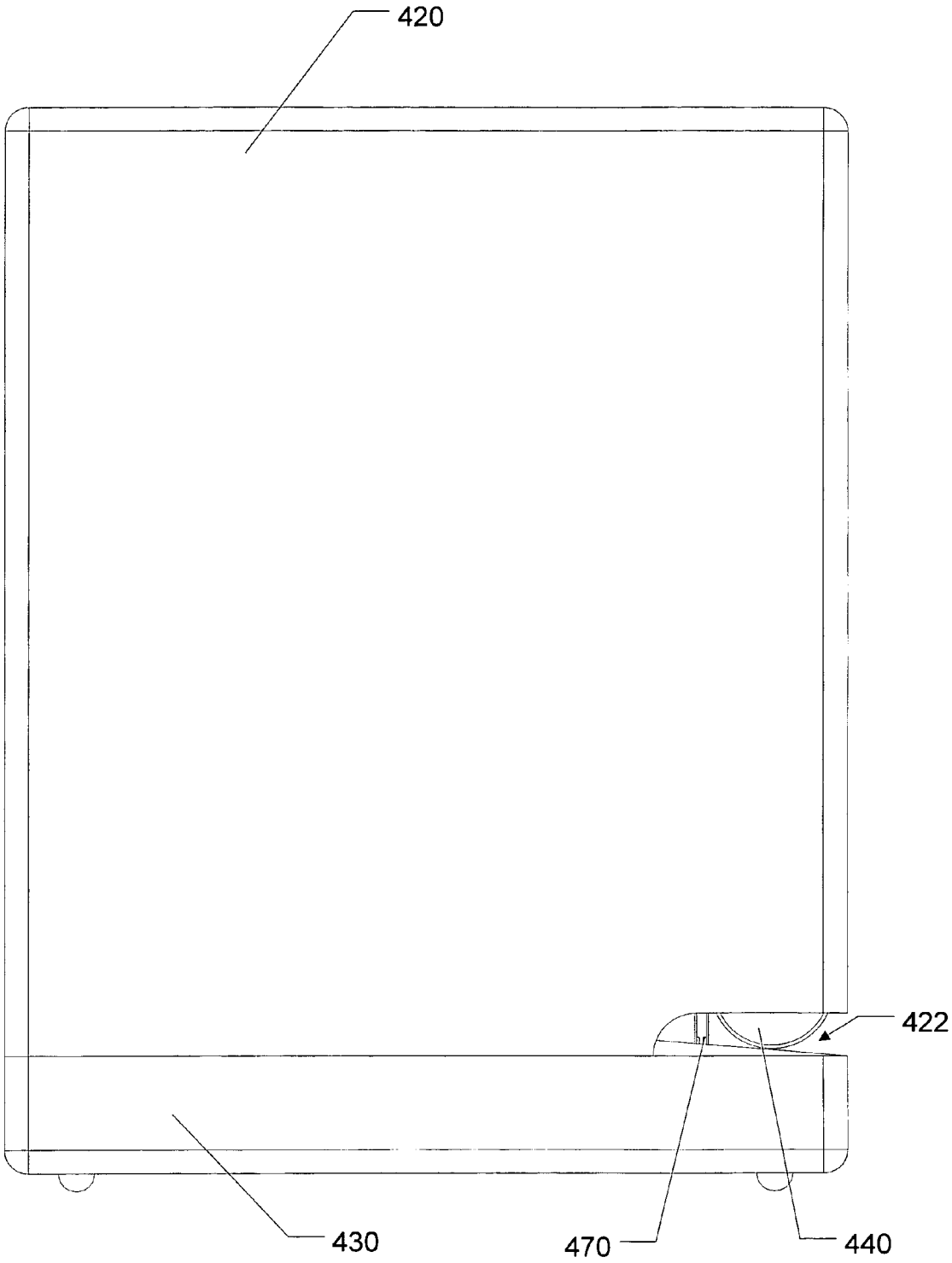
FIGS. 27 and 28 are side views of the embodiment of FIG. 25.
Figure 28:
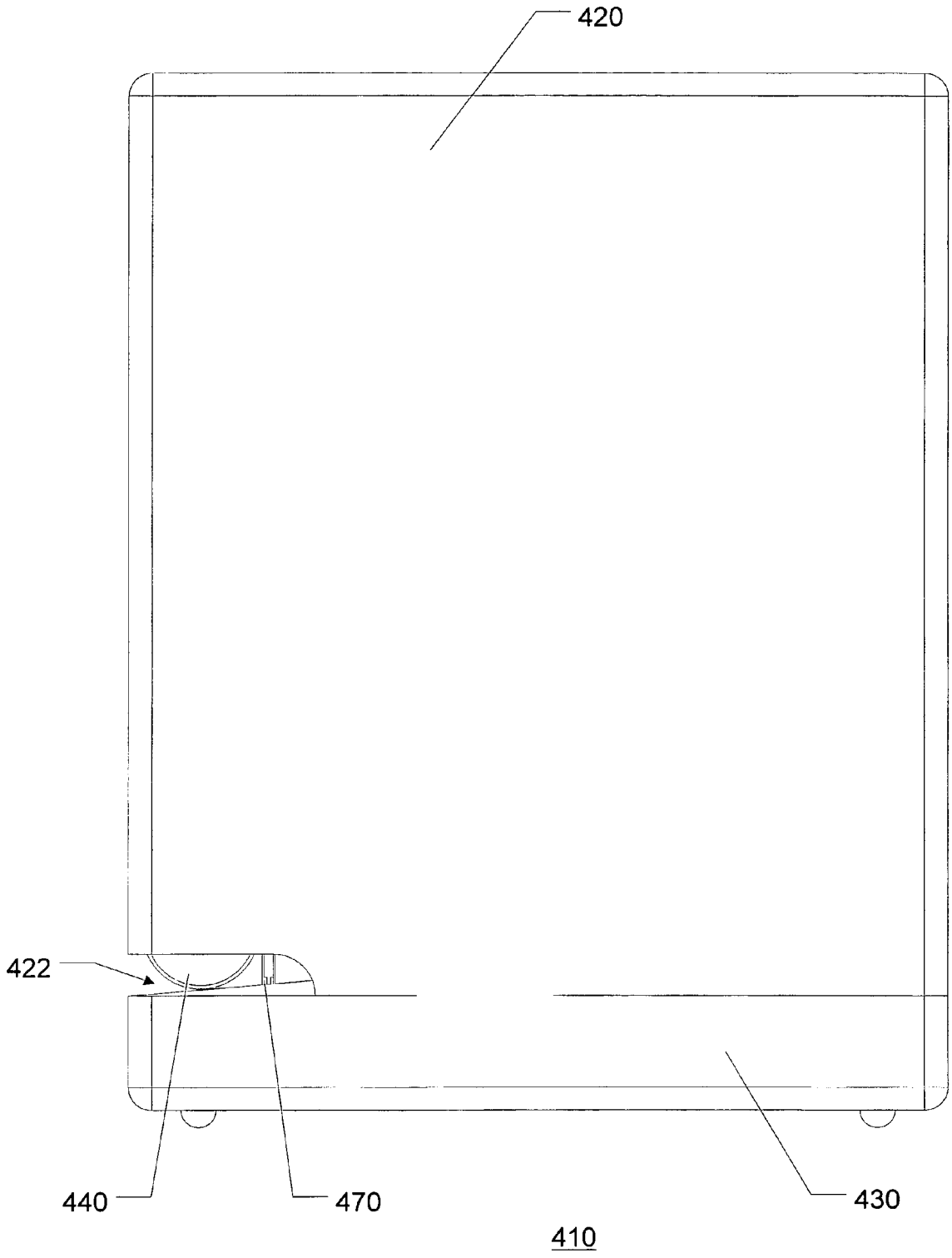
Figure 29:
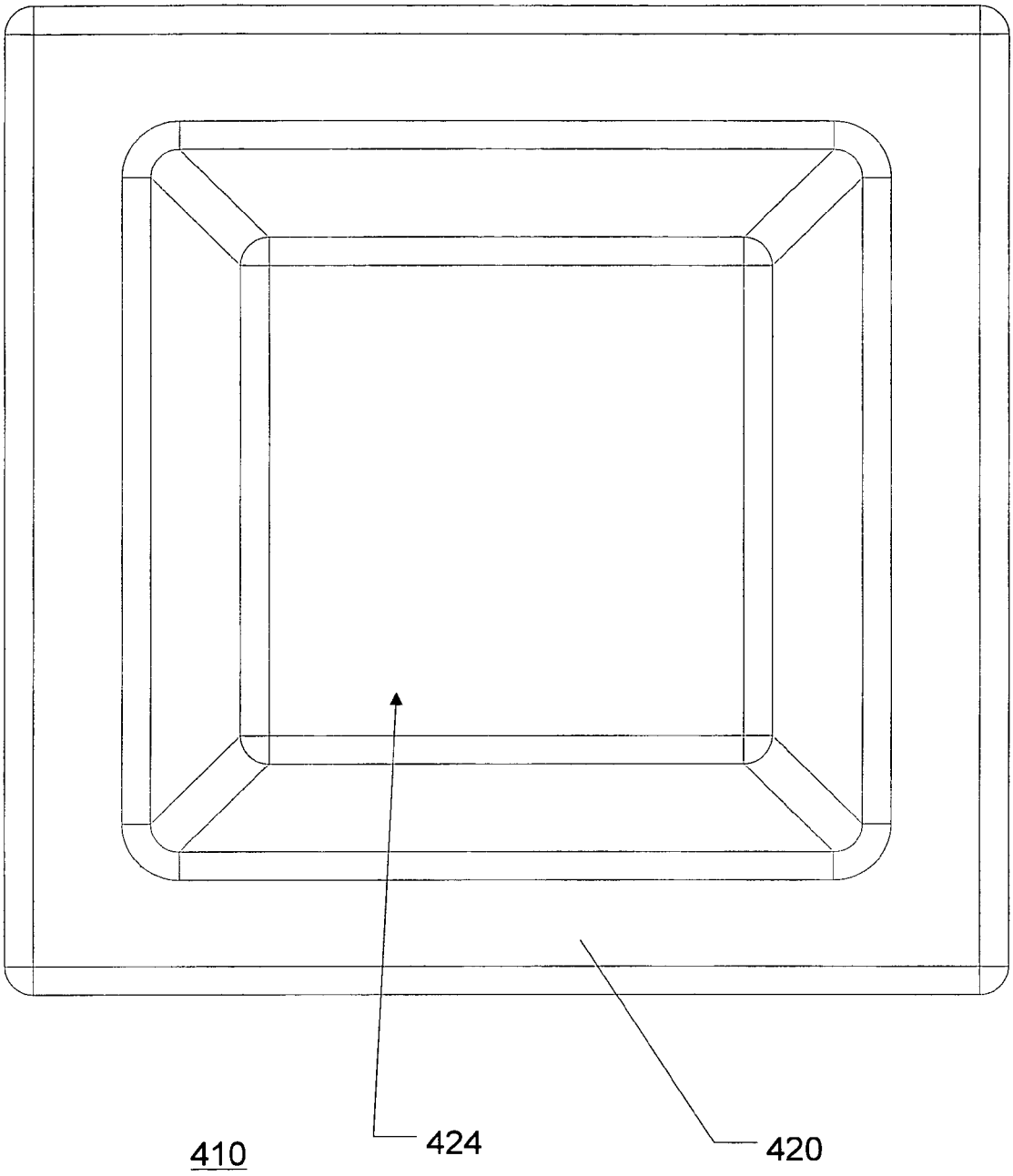
FIGS. 29 and 30 are top and bottom views of the embodiment of FIG. 25.
Figure 30:
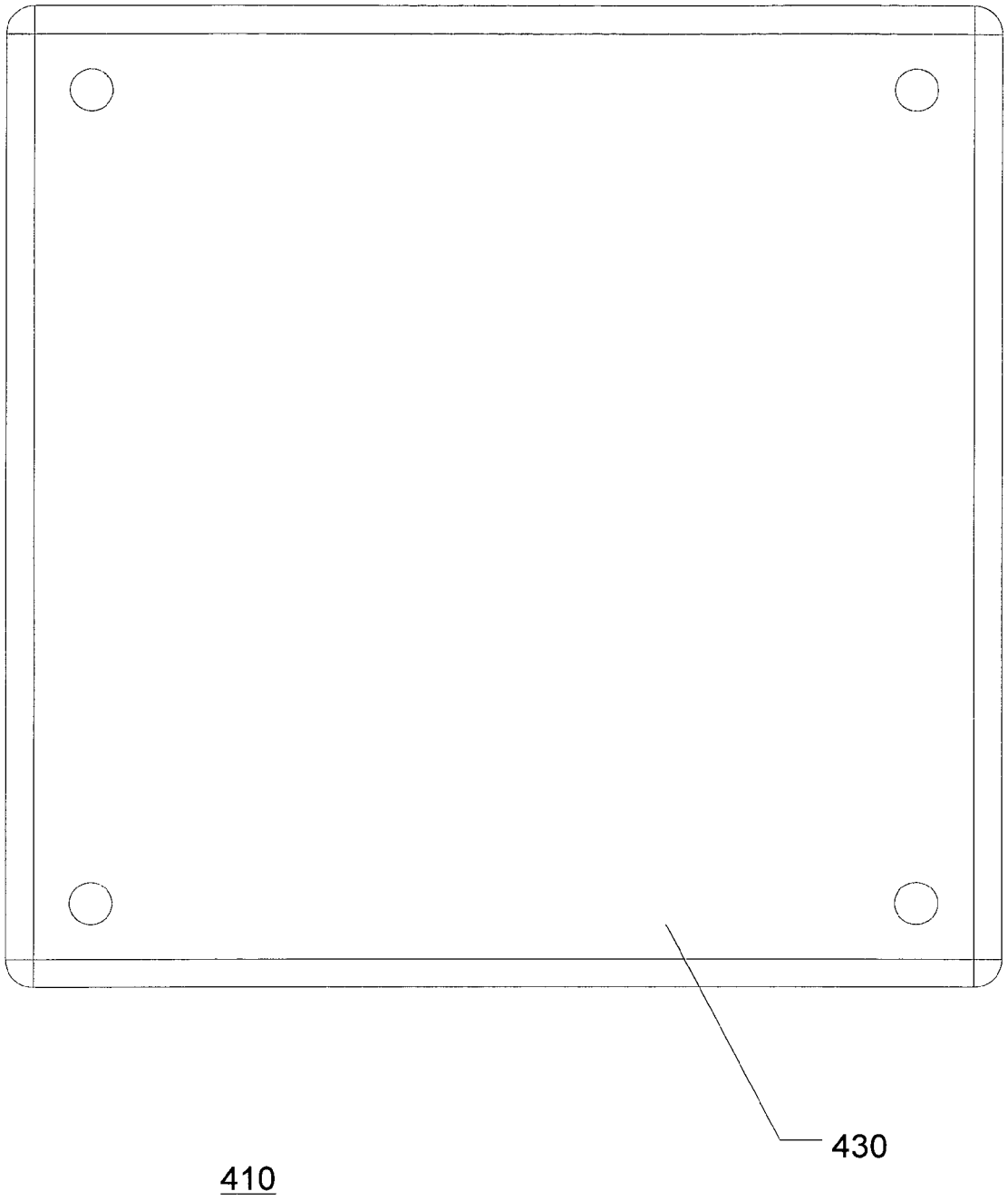
Figure 31:
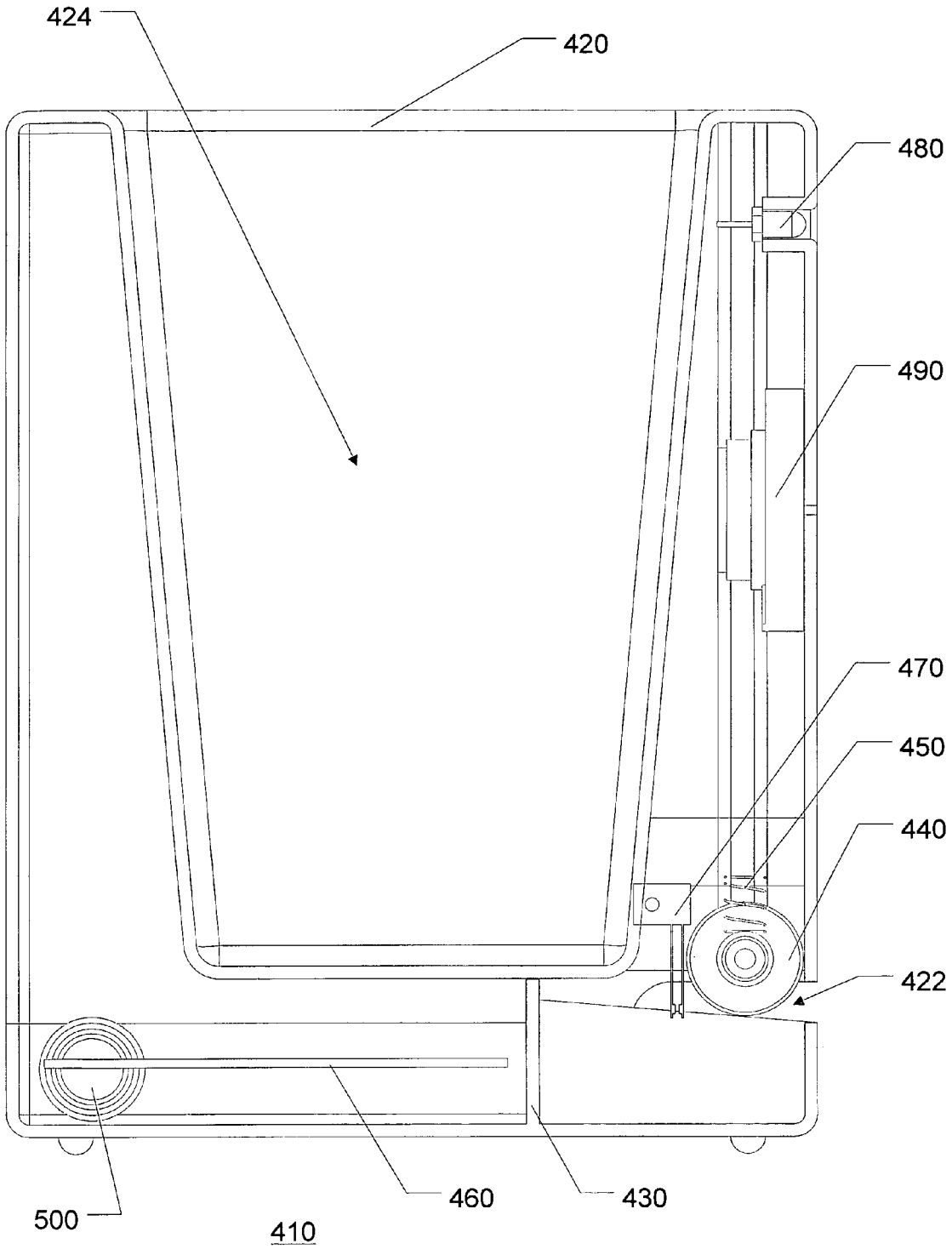
FIG. 31 is a cross-sectional view of the embodiment of FIG. 25.
Figure 32:
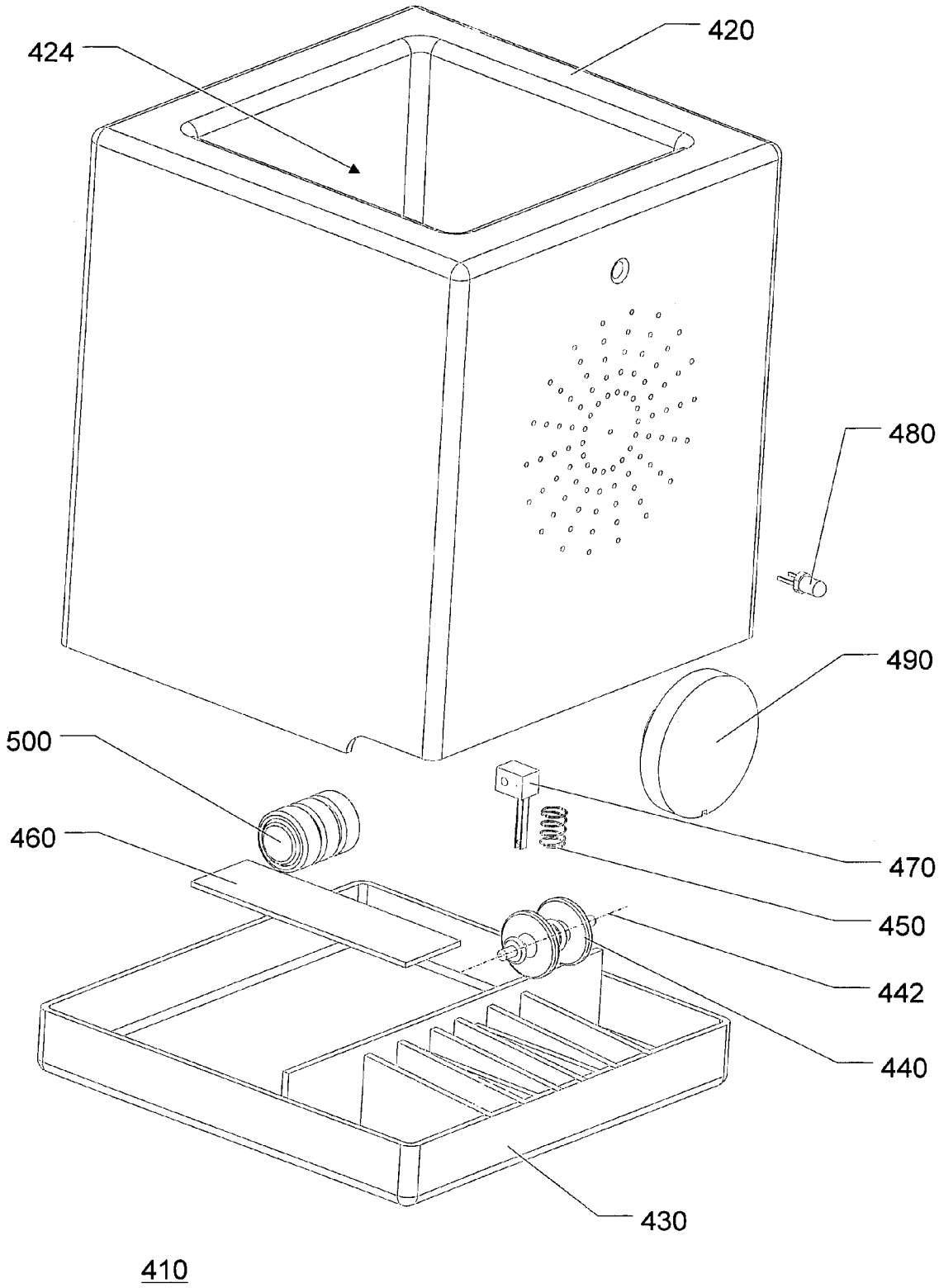
FIG. 32 is an exploded view of the embodiment of FIG. 25.

FIGS. 26 through 32 depict yet another example embodiment of a motion-detecting note holder 410 according to the invention. As shown, the note holder 410 may include a top housing 420, a bottom housing 430, a roller 440, and a spring 450. The top housing 420 and bottom housing 430 may have any desired shape and size, and may be made of plastic, metal, or any desirable material. The housings 420, 430 may be affixed to one another to form a portable housing via any practical manner, such as through the use of screws, glue, epoxy, solder, etc.

The housings 420, 430 may define an interior region that may contain a control module 460, a switch 470, a motion sensor 480, a speaker 490, and a power supply 500. The power supply 500 may be any source of electrical power. Such sources may include, but are not limited to, direct-current sources, such as batteries or rectifiers, and alternating-current sources, such as power outlets commonly found in homes and commercial buildings.

The housings 420, 430 may define a supply storage cavity 424. For example, the top housing 420 may be configured to provide a supply storage cavity or well 424 that is suitable for containing small office supplies, such as pens, pencils, paper clips, binder clips, rubber bands, business cards, sticky notes, and the like.

A gap or slot 422 between the top and bottom housings may serve as a receptacle for a note or a plurality of notes (not shown), which may be slid into the slot 422. As a note is slid into the slot 422, the note may contact the roller 440 and be directed between the roller 440 and the bottom housing 430. The roller 440 may be loaded by the spring 450 towards the bottom housing 430, and it may be substantially free to rotate about its own longitudinal axis 442. Friction between the note and the roller 440 may result in the rotation of the roller 440, and may also allow the note to slide between the roller 440 and the bottom housing 430. Thus, the note may be effectively retained with enough force so as not to become unintentionally dislodged. It should be understood that the note may be pulled back easily out of the slot due to the rotational freedom of the roller 440.

In addition to becoming retained once slid between the roller 440 and the bottom housing 430, the note may also make physical contact with the switch 470, effectively forcing the switch 470 from a normally open state to a closed state, for example. Alternatively, the switch 470 could be of a normally closed type that could be forced to an open state by the note. Thus, insertion of a note into the slot 422 may actuate the switch 470.

The switch 470 may include any number or combination of discrete components capable of carrying a current at a voltage differential sufficient to power the control module 460, motion sensor 480, and/or speaker 490. As shown, the switch 470 may include a leaf switch, for example. The switch 470 may include any combination of one or more discrete metal parts, discrete conductive ink coated film parts, carbon coated pads, etc. In a normally open configuration, the switch 470 may provide electrical communication between the control module 460 and the power supply 500 when closed. In a normally closed configuration, the switch 470, when opened, may generate a signal that is communicated to the control module 460 and causes the control module 460 to energize the motion sensor 480. Thus, the motion sensor may be activated when the switch 470 is actuated.

The control module 460 may include any number or combination of components, such as a general-purpose processor, for example, or any processor, controller, microprocessor, state machine, transistor logic, etc. The control module 460 may include discrete hardware components in various combinations with a digital signal processor (DSP), for example, and may include any storage media including, but not limited to, flash memory, EPROM memory, EEPROM memory, RAM memory, DRAM memory, SDRAM memory, ROM memory, registers, etc.

The motion sensor 480 may include any component or combination of components capable of developing a signal or charge upon the detection of motion in its vicinity. This may include, but is not limited to, infrared radiation sensors, visible radiation sensors, radio wave sensors, sound sensors, sonar sensors, vibration sensors, etc. Upon detection of motion in its vicinity, the motion sensor 480 may provide a motion-detected signal to the control module 460.

A prerecorded audio segment may be stored on the control module 460—in memory, for example. The audio segment may be a digital audio file stored in memory, for example, or it may be masked onto a component of the control module 460, such as during manufacture of a microprocessor or memory chip, for example. The audio segment may be, for example, a tone, a sequence of tones, music, or a verbal message. Generally, the audio segment may be any audio that informs a human that a note is waiting.

When the switch 470 is actuated, the control module 460, in response to receiving a motion-detected signal from the motion sensor 480, may then recall the audio segment and provide it to the speaker 490 for playback. The control module 460 may convert the audio segment into an analog signal, for example, and amplify it so that the speaker 490 is able to play it at a desired audible level. The motion-detecting note holder 410 may also include a volume control (not shown) to vary the volume level of the playback.

The note holder 410 may also include a timing sequence or delay function. That is, when the control module 460 receives a motion-detected signal from the motion sensor 480, the control module 460 may first determine whether the timing sequence is active before causing the audio segment to be played back. When the timing sequence has completed an operating cycle, meaning that a sufficient preset time has passed, the control module 460 may then cause a playback of the audible signal stored in the memory upon subsequent detection signals from the motion sensor 480. Through the inclusion of such a delay sequence, the motion-sensing note holder 410 may be prevented from playing the audio every time the motion sensor 480 senses motion. Rather, a note may be slid into the slot 422, thus latching the switch 470 to a closed position, for example. Then, after at least a preset period of time has elapsed, the note holder 410 can play the audio when the motion sensor 480 detects motion in its vicinity. Thus, such a delay function may prevent repeated playing and partial playing with re-starting of the audio while someone remains in the vicinity of the motion sensor 480, at least until no motion is detected in the vicinity of the motion sensor 480 for a pre-selected time. After the timing sequence has completed, the audio may be enabled to play again, thereby drawing attention to the note again the next time someone is in the vicinity of the motion sensor 480. Power may be removed from the control module 460 and the motion sensor 480 by removing the note from the slot 422, thus unlatching the switch 470 to an open position.

Though example embodiments of the invention have been described as including a leaf switch (such as depicted in FIGS. 1-8 and 17-36) and a push switch (such as depicted in FIGS. 9-16), it should be understood that any type of switch capable of activating the device when the switch is actuated may be employed. For example, it is contemplated that the switch may be a rotary switch, such that, when the housing is rotated (by 180°, for example), the motion sensor is activated and the control module begins processing motion-detected signals from the control module. It should further be understood that, the motion sensor may always be activated (though this would obviously be a power drain), and that the control module may only consider motion-detected signals if the switch has been actuated.

Further, though example embodiments of the invention have been described as providing an audible note-waiting indicator, any human-perceptible note-waiting indicator may be provided. For example, the device may include a light source, such as an LED, for example, in electrical communication with the control module. Upon receiving a motion-detected signal from the motion sensor, the control module may cause the light source to emit a light pattern that indicates that a note is waiting. For example, the light source may be made to blink or remain on continuously when motion is detected while the device is activated. The light source may be caused to remain off if the device is not activated, or if no motion has been detected. Alternatively, the light source may be caused to remain off if the device is not activated, to remain on if the device is activated and no motion is detected, and to blink if the device is activated and motion has been detected.

Though embodiments of the invention have been described as having note retention members such as a roller (as depicted in FIGS. 1-8 and 17-36) and a cavity (as depicted in FIGS. 9-16), it should be understood that any suitable retention member for retaining one or more notes or a notepad may be provided. For example, spring-loaded balls, flexible spring arms, magnetic clamping systems, rollers with tapered channels, over-center cam mechanisms, etc., may be employed in a device embodying the invention.

It should also be understood that an embodiment of the invention may include a switch, a motion sensor, a note-waiting indicator, and a controller in communication with the switch, the motion sensor, and the note-waiting indicator. When the switch is actuated, the controller, upon receiving a motion-detection signal from the motion sensor, causes the note-waiting indicator to provide a human-perceptible indication that a note is waiting. Such an embodiment may be useful to provide notification that a note is waiting even if the note itself is not retained by the device.

Another embodiment of a note holder according to the invention may include a note retention member, a motion sensor, a note-waiting indicator, and a controller in communication with the motion sensor and the note-waiting indicator. The controller, upon receiving a motion-detection signal from the motion sensor, causes the note-waiting indicator to provide a human-perceptible indication that a note is in the note retention member. Such an embodiment may be useful where it is unnecessary or undesirable to require switched activation of the device.

Another embodiment of the invention may include a motion sensor, a note-waiting indicator, and a controller in communication with the motion sensor and the note-waiting indicator. The controller, upon receiving a motion-detection signal from the motion sensor, causes the note-waiting indicator to provide a human-perceptible indication that a note is waiting. Such an embodiment may be useful to provide notification that a note is waiting even if the note itself is not retained by the device. Such an embodiment may also be useful where it is unnecessary or undesirable to require switched activation of the device as a prerequisite for providing the note-waiting indication.

The foregoing description details certain embodiments of the invention. It will be appreciated, however, that no matter how detailed the foregoing appears in text, the invention can be practiced in many ways. For example, though embodiments described as having a writing implement retention member, photograph retention member, supply tray, or supply cavity were described in connection with a note-actuated switch and spring-loaded note retention member. It should be understood, however, that any embodiment of the invention may include a writing implement retention member, photograph retention member, supply tray, or supply cavity.

Also, as is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed:

1. A motion-detecting note holder comprising:

a note retention member that retains a non-electronic note;

a switch that is actuated by insertion of the non-electronic note into the note retention member;

a motion sensor;

a note-waiting indicator; and a controller in communication with the switch, the motion sensor, and the note-waiting indicator, wherein, when the switch is actuated, the controller, upon receiving a motion-detection signal from the motion sensor, causes the note-waiting indicator to provide a human-perceptible indication that the note is retained in the note retention member.

2. The motion-detecting note holder of claim 1, wherein the note-waiting indicator includes a speaker, the controller has a pre-programmed audio segment stored thereon, and upon receiving the motion-detection signal from the motion sensor, the controller causes the audio segment to be played via the speaker.

3. The motion-detecting note holder of claim 2, wherein the controller prevents the audio segment from being played at least until a preset time period has elapsed.

4. The motion-detecting note holder of claim 1, wherein the note-waiting indicator includes a light source, and upon receiving the motion-detection signal from the motion sensor, the controller causes the light source to provide a predefined light pattern.

5. The motion-detecting note holder of claim 4, wherein the controller prevents the light pattern from being provided at least until a preset time period has elapsed.

6. The motion-detecting note holder of claim 4, wherein the note-waiting indicator includes a speaker, the controller has a pre-programmed audio segment stored thereon, and upon receiving the motion-detection signal from the motion sensor, the controller causes the audio segment to be played via the speaker.

7. The motion-detecting note holder of claim 6, wherein the controller prevents the audio segment from being played at least until a preset time period has elapsed.

8. The motion-detecting note holder of claim 1, further comprising a portable housing that contains the note retention member, the switch, the motion sensor, the note-waiting indicator, and the controller.

9. The motion-detecting note holder of claim 8, further comprising a writing implement retention member attached to the housing.

10. The motion-detecting note holder of claim 8, wherein the housing defines a supply storage cavity.

11. The motion-detecting note holder of claim 1, further comprising a photograph retention member.

* * * * *